US008523641B2

(12) United States Patent
Kuykendall et al.

(10) Patent No.: US 8,523,641 B2
(45) Date of Patent: Sep. 3, 2013

(54) SYSTEM, METHOD AND APPARATUS FOR AUTOMATICALLY FILLING A COIN CASSETTE

(75) Inventors: Julie L. Kuykendall, Palatine, IL (US); Jeffrey G. Knoll, Carol Stream, IL (US); Arthur J. Long, Palatine, IL (US); John R. Blake, St. Charles, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 2202 days.

(21) Appl. No.: 11/227,861

(22) Filed: Sep. 15, 2005

(65) Prior Publication Data

US 2006/0054455 A1 Mar. 16, 2006

Related U.S. Application Data

(60) Provisional application No. 60/610,050, filed on Sep. 15, 2004.

(51) Int. Cl.
*G07D 9/06* (2006.01)

(52) U.S. Cl.
USPC ..... 453/62; 453/61; 53/249; 53/254

(58) Field of Classification Search
USPC ..... 453/61, 62, 63; 53/254, 249
See application file for complete search history.

(56) References Cited

U.S. PATENT DOCUMENTS

| | | | | |
|---|---|---|---|---|
| 2,570,920 A | | 10/1951 | Clough et al. | 232/16 |
| 2,669,998 A | | 2/1954 | Buchholz | 133/8 |
| 2,750,949 A | | 6/1956 | Kulo et al. | 133/8 |
| 2,835,260 A | | 5/1958 | Buchholz | 133/8 |
| 2,865,561 A | | 12/1958 | Rosapepe | 232/7 |
| 3,132,654 A | | 5/1964 | Adams | 133/1 |
| 3,288,153 A | * | 11/1966 | Ballard et al. | 453/31 |
| 3,376,970 A | | 4/1968 | Roseberg | 198/40 |
| 3,585,782 A | * | 6/1971 | Staley | 53/167 |
| 3,771,583 A | | 11/1973 | Bottemiller | 160/327 |

(Continued)

FOREIGN PATENT DOCUMENTS

| | | |
|---|---|---|
| CA | 2235925 C | 11/1995 |
| CA | 2189330 C | 12/2000 |

(Continued)

OTHER PUBLICATIONS

Product Information for Canister Loading Solution Transact CLS Coin Dispenser by Telequip® (2004) 2 pages.

(Continued)

*Primary Examiner* — Joseph C Rodriguez
(74) *Attorney, Agent, or Firm* — Nixon Peabody LLP

(57) ABSTRACT

An automated coin tray refilling system includes a plurality of coin reservoirs and a plurality of coin dispensers for regulating the dispensing of coins from an associated one of the plurality of coin reservoirs. A collector point distribution member is adapted to receive coins from each of the plurality of coin dispensers at one portion thereof and to output the coins at another portion thereof. An interface module having an input end is disposed substantially adjacent the collector point distribution member output and includes an output end for dispensing coins. A coin interface tray is adapted to receive at least one coin tray and at least one processor is provided. The interface module and/or coin interface tray includes a drive system configured to move interface module and/or coin interface tray relative to one another.

7 Claims, 6 Drawing Sheets

(56) References Cited

U.S. PATENT DOCUMENTS

| | | | | |
|---|---|---|---|---|
| 3,778,595 | A | 12/1973 | Hatanaka et al. | 235/61.7 B |
| 3,916,922 | A | 11/1975 | Prumm | 133/3 R |
| 3,998,237 | A | 12/1976 | Kressin | 133/3 A |
| 3,998,376 | A | 12/1976 | Myers et al. | 229/33 |
| 4,050,218 | A | 9/1977 | Call | 53/167 |
| 4,058,999 | A | 11/1977 | Gabriele | |
| 4,059,122 | A | 11/1977 | Kinoshita | 133/3 D |
| 4,075,460 | A | 2/1978 | Gorgens | 235/420 |
| 4,124,111 | A | 11/1978 | Hayashi | 194/102 |
| 4,150,740 | A | 4/1979 | Douno | 194/4 C |
| 4,166,945 | A | 9/1979 | Inoyama et al. | 235/379 |
| 4,172,462 | A | 10/1979 | Uchida et al. | 133/3 A |
| 4,179,685 | A | 12/1979 | O'Maley | 340/146.3 H |
| 4,179,723 | A | 12/1979 | Spencer | 361/384 |
| 4,184,366 | A | 1/1980 | Butler | 73/163 |
| 4,197,986 | A | 4/1980 | Nagata | 235/379 |
| 4,208,549 | A | 6/1980 | Polillo et al. | 179/6.3 R |
| 4,228,812 | A | 10/1980 | Marti | 133/3 F |
| 4,232,295 | A | 11/1980 | McConnell | 340/152 R |
| 4,234,003 | A | 11/1980 | Ristvedt et al. | 133/3 |
| 4,249,552 | A | 2/1981 | Margolin et al. | 133/1 R |
| 4,251,867 | A | 2/1981 | Uchida et al. | 364/408 |
| 4,286,703 | A | 9/1981 | Schuller et al. | 194/100 A |
| RE30,773 | E | 10/1981 | Glaser et al. | 235/379 |
| 4,310,885 | A | 1/1982 | Azcua et al. | 364/405 |
| 4,317,957 | A | 3/1982 | Sendrow | 178/22.08 |
| 4,341,951 | A | 7/1982 | Benton | 235/379 |
| 4,355,369 | A | 10/1982 | Garvin | 364/900 |
| 4,360,034 | A | 11/1982 | Davila et al. | 133/3 D |
| 4,369,442 | A | 1/1983 | Werth et al. | 340/825.35 |
| 4,380,316 | A | 4/1983 | Glinka et al. | 232/16 |
| 4,383,540 | A | 5/1983 | De Meyer et al. | 133/3 H |
| 4,385,285 | A | 5/1983 | Horst et al. | 382/3 |
| 4,412,292 | A | 10/1983 | Sedam et al. | 364/479 |
| 4,416,299 | A | 11/1983 | Bergman | 133/1 R |
| 4,417,136 | A | 11/1983 | Rushby et al. | 235/379 |
| 4,423,316 | A | 12/1983 | Sano et al. | 235/379 |
| 4,434,359 | A | 2/1984 | Watanabe | 235/379 |
| 4,436,103 | A | 3/1984 | Dick | 133/3 D |
| 4,454,414 | A | 6/1984 | Benton | 235/379 |
| 4,474,197 | A | 10/1984 | Kinoshita et al. | 133/4 A |
| 4,488,116 | A | 12/1984 | Plesko | 324/236 |
| 4,531,531 | A | 7/1985 | Johnson et al. | 133/3 |
| 4,543,969 | A | 10/1985 | Rasmussen | 133/3 |
| 4,549,561 | A | 10/1985 | Johnson et al. | 133/3 |
| 4,556,140 | A | 12/1985 | Okada | 194/4 C |
| 4,558,711 | A | 12/1985 | Ikuta Yoshiaki et al. | 133/3 F |
| 4,564,036 | A | 1/1986 | Ristvedt | 133/3 |
| 4,570,655 | A | 2/1986 | Raterman | 133/3 |
| 4,594,664 | A | 6/1986 | Hashimoto | 364/405 |
| 4,602,332 | A | 7/1986 | Hirose et al. | 364/408 |
| 4,607,649 | A | 8/1986 | Taipale et al. | 133/3 C |
| 4,620,559 | A | 11/1986 | Childers et al. | 133/3 R |
| 4,641,239 | A | 2/1987 | Takesako | 364/408 |
| 4,674,260 | A | 6/1987 | Rasmussen et al. | 53/212 |
| 4,681,128 | A | 7/1987 | Ristvedt et al. | 453/6 |
| 4,705,154 | A | 11/1987 | Masho et al. | 194/319 |
| 4,718,218 | A | 1/1988 | Ristvedt | 53/532 |
| 4,731,043 | A | 3/1988 | Ristvedt et al. | 453/6 |
| 4,733,765 | A | 3/1988 | Watanabe | 194/206 |
| 4,749,074 | A | 6/1988 | Ueki et al. | 194/317 |
| 4,753,624 | A | 6/1988 | Adams et al. | 453/10 |
| 4,753,625 | A | 6/1988 | Okada | 453/32 |
| 4,765,464 | A | 8/1988 | Ristvedt | 206/0.82 |
| 4,766,548 | A | 8/1988 | Cedrone et al. | 364/479 |
| 4,775,353 | A | 10/1988 | Childers et al. | 453/6 |
| 4,775,354 | A | 10/1988 | Rasmussen et al. | 453/10 |
| 4,778,983 | A | 10/1988 | Ushikubo | 235/381 |
| 4,803,347 | A | 2/1989 | Sugahara et al. | 235/379 |
| 4,804,830 | A | 2/1989 | Miyagisima et al. | 235/379 |
| 4,812,629 | A | 3/1989 | O'Neil et al. | 235/383 |
| 4,839,505 | A | 6/1989 | Bradt et al. | 235/381 |
| 4,844,369 | A | 7/1989 | Kanayachi | 242/56 R |
| 4,848,556 | A | 7/1989 | Shah et al. | 194/212 |
| 4,863,414 | A | 9/1989 | Ristvedt et al. | 453/6 |
| 4,883,158 | A | 11/1989 | Kobayashi et al. | 194/217 |
| 4,884,212 | A | 11/1989 | Stutsman | 364/479 |
| 4,900,909 | A | 2/1990 | Nagashima et al. | 235/487 |
| 4,908,516 | A | 3/1990 | West | 250/556 |
| 4,921,463 | A | 5/1990 | Primdahl et al. | 453/3 |
| 4,936,435 | A | 6/1990 | Griner | 194/317 |
| 4,949,532 | A | 8/1990 | Fujimagari et al. | |
| 4,953,086 | A | 8/1990 | Fukatsu | 364/408 |
| 4,954,697 | A | 9/1990 | Kokubun et al. | 235/381 |
| 4,964,495 | A | 10/1990 | Rasmussen | 194/344 |
| 4,966,570 | A | 10/1990 | Ristvedt et al. | 453/6 |
| 4,970,655 | A | 11/1990 | Winn et al. | 364/479 |
| 4,971,187 | A | 11/1990 | Furuya et al. | 194/318 |
| 4,988,849 | A | 1/1991 | Sasaki et al. | 235/379 |
| 4,992,647 | A | 2/1991 | Konishi et al. | 235/379 |
| 4,995,848 | A | 2/1991 | Goh | 453/3 |
| 5,009,627 | A | 4/1991 | Rasmussen | 453/10 |
| 5,010,238 | A | 4/1991 | Kadono et al. | 235/379 |
| 5,010,485 | A | 4/1991 | Bigari | 364/408 |
| 5,011,455 | A | 4/1991 | Rasmussen | 453/10 |
| 5,022,889 | A | 6/1991 | Ristvedt et al. | 453/6 |
| 5,025,139 | A | 6/1991 | Halliburton, Jr. | 235/379 |
| 5,026,320 | A | 6/1991 | Rasmussen | 453/6 |
| 5,031,098 | A | 7/1991 | Miller et al. | 364/405 |
| 5,033,602 | A | 7/1991 | Saarinen et al. | 194/334 |
| 5,039,848 | A | 8/1991 | Stoken | 235/381 |
| 5,055,086 | A | 10/1991 | Raterman et al. | 453/10 |
| 5,055,657 | A | 10/1991 | Miller et al. | 235/381 |
| 5,064,999 | A | 11/1991 | Okamoto et al. | 235/379 |
| 5,080,633 | A | 1/1992 | Ristvedt et al. | 435/6 |
| 5,091,713 | A | 2/1992 | Horne et al. | 340/541 |
| 5,104,353 | A | 4/1992 | Ristvedt et al. | 453/6 |
| 5,105,601 | A | 4/1992 | Horiguchi et al. | 53/465 |
| 5,106,338 | A | 4/1992 | Rasmussen et al. | 453/10 |
| 5,111,927 | A | 5/1992 | Schulze, Jr. | 194/209 |
| 5,114,381 | A | 5/1992 | Ueda et al. | 453/57 |
| 5,120,945 | A | 6/1992 | Nishibe et al. | 235/379 |
| 5,123,873 | A | 6/1992 | Rasmussen | 453/10 |
| 5,129,205 | A | 7/1992 | Rasmussen | 53/52 |
| 5,135,435 | A | 8/1992 | Rasmussen | 453/56 |
| 5,140,517 | A | 8/1992 | Nagata et al. | 364/408 |
| 5,141,443 | A | 8/1992 | Rasmussen et al. | 453/10 |
| 5,141,472 | A | 8/1992 | Todd et al. | 453/10 |
| 5,145,455 | A | 9/1992 | Todd | 453/6 |
| 5,146,067 | A | 9/1992 | Sloan et al. | 235/381 |
| 5,154,272 | A | 10/1992 | Nishiumi et al. | 194/318 |
| 5,163,866 | A | 11/1992 | Rasmussen | 453/10 |
| 5,163,867 | A | 11/1992 | Rasmussen | 453/10 |
| 5,163,868 | A | 11/1992 | Adams et al. | 453/11 |
| 5,167,313 | A | 12/1992 | Dobbins et al. | 194/317 |
| 5,175,416 | A | 12/1992 | Mansvelt et al. | 235/379 |
| 5,176,565 | A | 1/1993 | Ristvedt et al. | 453/6 |
| 5,179,517 | A | 1/1993 | Sarbin et al. | 364/410 |
| 5,183,142 | A | 2/1993 | Latchinian et al. | 194/206 |
| 5,184,709 | A | 2/1993 | Nishiumi et al. | 194/318 |
| 5,194,037 | A | 3/1993 | Jones et al. | 453/10 |
| 5,197,919 | A | 3/1993 | Geib et al. | 453/10 |
| 5,205,780 | A | 4/1993 | Rasmussen | 453/10 |
| 5,207,784 | A | 5/1993 | Schwartzendruber | 221/6 |
| 5,209,696 | A | 5/1993 | Rasmussen et al. | 453/10 |
| 5,236,071 | A | 8/1993 | Lee | 194/200 |
| 5,243,174 | A | 9/1993 | Veeneman et al. | 235/381 |
| 5,251,738 | A | 10/1993 | Dabrowski | 194/206 |
| 5,252,811 | A | 10/1993 | Henochowicz et al. | 235/379 |
| 5,253,167 | A | 10/1993 | Yoshida et al. | 364/408 |
| 5,263,566 | A | 11/1993 | Nara et al. | 194/318 |
| 5,265,874 | A | 11/1993 | Dickinson et al. | 273/138 A |
| 5,268,561 | A | 12/1993 | Kimura et al. | 235/384 |
| 5,277,651 | A | 1/1994 | Rasmussen et al. | 453/10 |
| 5,282,127 | A | 1/1994 | Mii | 364/130 |
| 5,286,226 | A | 2/1994 | Rasmussen | 453/10 |
| 5,286,954 | A | 2/1994 | Sato et al. | 235/379 |
| 5,291,003 | A | 3/1994 | Avnet et al. | 235/381 |
| 5,291,560 | A | 3/1994 | Daugman | 382/2 |
| 5,293,981 | A | 3/1994 | Abe et al. | 194/345 |
| 5,297,030 | A | 3/1994 | Vassigh et al. | 364/405 |
| 5,297,598 | A | 3/1994 | Rasmussen | 141/314 |
| 5,297,986 | A | 3/1994 | Ristvedt et al. | 453/6 |
| 5,299,977 | A | 4/1994 | Mazur et al. | 453/10 |

| | | | | |
|---|---|---|---|---|
| 5,324,922 | A | 6/1994 | Roberts | 235/375 |
| 5,326,104 | A | 7/1994 | Pease et al. | 273/138 A |
| 5,370,575 | A | 12/1994 | Geib et al. | 453/3 |
| 5,372,542 | A | 12/1994 | Geib et al. | 453/10 |
| 5,374,814 | A | 12/1994 | Kako et al. | 235/379 |
| 5,379,344 | A | 1/1995 | Larsson et al. | 380/23 |
| 5,379,875 | A | 1/1995 | Shames et al. | 194/317 |
| 5,382,191 | A | 1/1995 | Rasmussen | 453/11 |
| 5,390,776 | A | 2/1995 | Thompson | 194/346 |
| 5,401,211 | A | 3/1995 | Geib et al. | 453/10 |
| 5,404,986 | A | 4/1995 | Hossfield et al. | 194/317 |
| 5,410,590 | A | 4/1995 | Blood et al. | 379/147 |
| RE34,934 | E | 5/1995 | Raterman et al. | 453/10 |
| 5,425,669 | A | 6/1995 | Geib et al. | 453/10 |
| 5,429,550 | A | 7/1995 | Mazur et al. | 453/10 |
| 5,440,108 | A | 8/1995 | Tran et al. | 235/381 |
| 5,450,938 | A | 9/1995 | Rademacher | 194/206 |
| 5,453,047 | A | 9/1995 | Mazur et al. | 453/10 |
| 5,468,182 | A | 11/1995 | Geib | 453/10 |
| 5,470,079 | A | 11/1995 | LeStrange et al. | 273/138 A |
| 5,474,495 | A | 12/1995 | Geib et al. | 453/3 |
| 5,474,497 | A | 12/1995 | Jones et al. | 453/17 |
| 5,480,348 | A | 1/1996 | Mazur et al. | 453/10 |
| 5,489,237 | A | 2/1996 | Geib et al. | 453/12 |
| 5,500,514 | A | 3/1996 | Veeneman et al. | 235/381 |
| 5,501,631 | A | 3/1996 | Mennie et al. | 453/3 |
| 5,507,379 | A | 4/1996 | Mazur et al. | 194/318 |
| 5,514,034 | A | 5/1996 | Jones et al. | 453/10 |
| 5,520,577 | A | 5/1996 | Rasmussen | 453/56 |
| 5,538,468 | A | 7/1996 | Ristvedt et al. | 453/3 |
| 5,542,880 | A | 8/1996 | Geib et al. | 453/10 |
| 5,542,881 | A | 8/1996 | Geib | 453/10 |
| 5,553,320 | A | 9/1996 | Matsuura et al. | 235/379 |
| 5,559,887 | A | 9/1996 | Davis et al. | 380/24 |
| 5,564,546 | A | 10/1996 | Molbak et al. | 194/216 |
| 5,564,974 | A | 10/1996 | Mazur et al. | 453/10 |
| 5,564,978 | A | 10/1996 | Jones et al. | 453/17 |
| 5,570,465 | A | 10/1996 | Tsakanikas | 395/114 |
| 5,573,457 | A | 11/1996 | Watts et al. | 453/31 |
| 5,584,758 | A | 12/1996 | Geib | 453/10 |
| 5,592,377 | A | 1/1997 | Lipkin | 395/242 |
| 5,602,933 | A | 2/1997 | Blackwell et al. | 382/116 |
| 5,620,079 | A | 4/1997 | Molbak | 194/217 |
| 5,623,547 | A | 4/1997 | Jones et al. | 380/24 |
| 5,625,562 | A | 4/1997 | Veeneman et al. | 364/479.05 |
| 5,630,494 | A | 5/1997 | Strauts | 194/317 |
| 5,641,050 | A | 6/1997 | Smith et al. | 194/210 |
| 5,650,605 | A | 7/1997 | Morioka et al. | 235/379 |
| 5,650,761 | A | 7/1997 | Gomm et al. | 235/381 |
| 5,652,421 | A | 7/1997 | Veeneman et al. | 235/381 |
| 5,665,952 | A | 9/1997 | Ziarno | 235/380 |
| 5,679,070 | A | 10/1997 | Ishida et al. | 453/41 |
| 5,684,597 | A | 11/1997 | Hossfield et al. | 356/384 |
| 5,696,366 | A | 12/1997 | Ziarno | 235/380 |
| 5,743,373 | A | 4/1998 | Strauts | 194/318 |
| 5,746,299 | A | 5/1998 | Molbak et al. | 194/200 |
| 5,774,874 | A | 6/1998 | Veeneman et al. | 705/27 |
| 5,782,686 | A | 7/1998 | Geib et al. | 453/10 |
| 5,799,767 | A | 9/1998 | Molbak | 194/217 |
| 5,813,510 | A | 9/1998 | Rademacher | 194/206 |
| 5,823,315 | A | 10/1998 | Hoffman et al. | 194/203 |
| 5,830,054 | A | 11/1998 | Petri | 453/5 |
| 5,838,812 | A | 11/1998 | Pare, Jr. et al. | 382/115 |
| 5,842,188 | A | 11/1998 | Ramsey et al. | 705/416 |
| 5,842,916 | A | 12/1998 | Gerrity et al. | 453/57 |
| 5,850,076 | A | 12/1998 | Morioka et al. | 235/379 |
| 5,854,581 | A | 12/1998 | Mori et al. | 235/379 |
| 5,865,673 | A | 2/1999 | Geib et al. | 453/10 |
| 5,880,444 | A | 3/1999 | Shibata et al. | 235/379 |
| 5,892,211 | A | 4/1999 | Davis et al. | 235/380 |
| 5,892,827 | A | 4/1999 | Beach et al. | 380/24 |
| 5,909,793 | A | 6/1999 | Beach et al. | 194/210 |
| 5,909,794 | A | 6/1999 | Molbak et al. | 194/216 |
| 5,913,399 | A | 6/1999 | Takemoto et al. | 194/200 |
| 5,918,748 | A | 7/1999 | Clark et al. | 209/534 |
| 5,940,623 | A | 8/1999 | Watts et al. | 395/712 |
| 5,944,600 | A | 8/1999 | Zimmermann | 435/10 |
| 5,951,476 | A | 9/1999 | Beach | 600/437 |
| 5,957,262 | A | 9/1999 | Molbak et al. | 194/200 |
| 5,988,348 | A | 11/1999 | Martin et al. | 194/317 |
| 5,995,949 | A | 11/1999 | Morioka et al. | 705/43 |
| 5,997,395 | A | 12/1999 | Geib et al. | 453/10 |
| 6,017,270 | A | 1/2000 | Ristvedt et al. | 453/5 |
| 6,021,883 | A | 2/2000 | Casanova et al. | 194/217 |
| 6,032,859 | A | 3/2000 | Muehlberger et al. | 235/449 |
| 6,039,644 | A | 3/2000 | Geib et al. | 453/10 |
| 6,039,645 | A | 3/2000 | Mazur | 453/10 |
| 6,042,470 | A | 3/2000 | Geib et al. | 453/10 |
| 6,047,807 | A | 4/2000 | Molbak | 194/217 |
| 6,047,808 | A | 4/2000 | Neubarth et al. | 194/317 |
| 6,056,104 | A | 5/2000 | Neubarth et al. | 194/317 |
| 6,080,056 | A | 6/2000 | Karlsson | 453/3 |
| 6,082,519 | A | 7/2000 | Martin et al. | 194/350 |
| 6,086,471 | A | 7/2000 | Zimmermann | 453/3 |
| 6,095,313 | A | 8/2000 | Molbak et al. | 194/344 |
| 6,116,402 | A | 9/2000 | Beach et al. | 194/216 |
| 6,131,625 | A | 10/2000 | Casanova et al. | 141/314 |
| 6,139,418 | A | 10/2000 | Geib et al. | 453/10 |
| 6,142,285 | A | 11/2000 | Panzeri et al. | 194/328 |
| 6,145,738 | A | 11/2000 | Stinson et al. | 235/379 |
| 6,154,879 | A | 11/2000 | Pare, Jr. et al. | 902/3 |
| 6,168,001 | B1 | 1/2001 | Davis | 194/200 |
| 6,171,182 | B1 | 1/2001 | Geib et al. | 453/10 |
| 6,174,230 | B1 | 1/2001 | Gerrity et al. | 453/57 |
| 6,196,371 | B1 | 3/2001 | Martin et al. | 194/317 |
| 6,196,913 | B1 | 3/2001 | Geib et al. | 453/10 |
| 6,200,213 | B1 * | 3/2001 | Cole | 453/30 |
| 6,230,928 | B1 | 5/2001 | Hanna et al. | 221/13 |
| 6,264,545 | B1 | 7/2001 | Magee et al. | 453/3 |
| 6,308,887 | B1 | 10/2001 | Korman et al. | 235/379 |
| 6,318,536 | B1 | 11/2001 | Korman et al. | 194/217 |
| 6,318,537 | B1 | 11/2001 | Jones et al. | 194/346 |
| 6,349,972 | B1 | 2/2002 | Geiger et al. | 283/67 |
| 6,412,620 | B1 | 7/2002 | Imura | 194/317 |
| 6,431,342 | B1 | 8/2002 | Schwartz | 194/346 |
| 6,438,230 | B1 | 8/2002 | Moore | 380/42 |
| 6,456,928 | B1 | 9/2002 | Johnson | 701/114 |
| 6,471,030 | B1 | 10/2002 | Neubarth et al. | 194/317 |
| 6,474,548 | B1 | 11/2002 | Montross et al. | 235/379 |
| 6,484,863 | B1 | 11/2002 | Molbak | 194/216 |
| 6,484,884 | B1 | 11/2002 | Gerrity et al. | 209/233 |
| 6,494,776 | B1 | 12/2002 | Molbak | 453/32 |
| 6,499,277 | B1 | 12/2002 | Warner et al. | 53/447 |
| 6,503,138 | B2 | 1/2003 | Spoehr et al. | 453/10 |
| 6,520,308 | B1 | 2/2003 | Martin et al. | 194/317 |
| 6,522,772 | B1 | 2/2003 | Morrison et al. | 382/124 |
| 6,547,131 | B1 | 4/2003 | Foodman et al. | 235/380 |
| 6,552,781 | B1 | 4/2003 | Rompel et al. | 256/71 |
| 6,554,185 | B1 | 4/2003 | Montross et al. | 235/379 |
| 6,579,165 | B2 | 6/2003 | Kuhlin et al. | 453/3 |
| 6,581,042 | B2 | 6/2003 | Pare, Jr. et al. | 705/40 |
| 6,602,125 | B2 | 8/2003 | Martin | 453/12 |
| 6,609,604 | B1 | 8/2003 | Jones et al. | 194/302 |
| 6,612,921 | B2 | 9/2003 | Geib et al. | 453/13 |
| 6,637,576 | B1 | 10/2003 | Jones et al. | 194/216 |
| 6,640,956 | B1 | 11/2003 | Zwieg et al. | 194/328 |
| 6,644,696 | B2 | 11/2003 | Brown et al. | 283/67 |
| 6,655,585 | B2 | 12/2003 | Shinn | 235/382 |
| 6,659,259 | B2 | 12/2003 | Knox et al. | 194/217 |
| 6,662,166 | B2 | 12/2003 | Pare, Jr. et al. | 705/39 |
| 6,663,675 | B2 | 12/2003 | Blake et al. | 753/63 |
| 6,666,318 | B2 | 12/2003 | Gerrity et al. | 194/347 |
| 6,755,730 | B2 | 6/2004 | Blake et al. | 453/3 |
| 6,758,316 | B2 | 7/2004 | Molbak | 194/200 |
| 6,761,308 | B1 | 7/2004 | Hanna et al. | 235/379 |
| 6,766,892 | B2 | 7/2004 | Martin et al. | 194/317 |
| 6,783,452 | B2 | 8/2004 | Hino et al. | 453/3 |
| 6,783,785 | B1 | 8/2004 | Raghavan et al. | 426/489 |
| 6,786,398 | B1 | 9/2004 | Stinson et al. | 235/379 |
| 6,854,581 | B2 | 2/2005 | Molbak | 194/344 |
| 6,854,640 | B2 | 2/2005 | Peklo | 235/100 |
| 6,863,168 | B1 | 3/2005 | Gerrity et al. | 194/347 |
| 6,892,871 | B2 | 5/2005 | Strauts et al. | 194/302 |
| 6,896,118 | B2 | 5/2005 | Jones et al. | 194/217 |
| 6,928,546 | B1 | 8/2005 | Nanavati et al. | 713/186 |
| 6,950,810 | B2 | 9/2005 | Lapsley et al. | 705/78 |
| 6,953,150 | B2 | 10/2005 | Shepley et al. | 235/379 |
| 6,957,746 | B2 | 10/2005 | Martin et al. | 221/131 |

| | | | | |
|---|---|---|---|---|
| 6,966,417 | B2 | 11/2005 | Peklo et al. | 194/344 |
| 6,976,570 | B2 | 12/2005 | Molbak | 194/215 |
| 6,988,606 | B2 | 1/2006 | Geib et al. | 194/334 |
| 6,991,530 | B2 | 1/2006 | Hino et al. | 453/3 |
| 7,004,831 | B2 | 2/2006 | Hino et al. | 453/5 |
| 7,014,029 | B2 | 3/2006 | Winters | 194/302 |
| 7,014,108 | B2 | 3/2006 | Sorenson et al. | 235/381 |
| 7,017,729 | B2 | 3/2006 | Gerrity et al. | 194/347 |
| 7,018,286 | B2 | 3/2006 | Blake et al. | 453/61 |
| 7,028,827 | B1 | 4/2006 | Molbak et al. | 194/346 |
| 7,036,651 | B2 | 5/2006 | Tam et al. | 194/217 |
| 7,083,036 | B2 | 8/2006 | Adams | 194/223 |
| 7,113,929 | B1 | 9/2006 | Beach et al. | 705/65 |
| 7,131,580 | B2 | 11/2006 | Molbak | 235/379 |
| 7,149,336 | B2 | 12/2006 | Jones et al. | 382/135 |
| 7,152,727 | B2 | 12/2006 | Waechter | 194/317 |
| 7,158,662 | B2 | 1/2007 | Chiles | 382/135 |
| 7,188,720 | B2 | 3/2007 | Geib et al. | 194/302 |
| 7,213,697 | B2 | 5/2007 | Martin et al. | 194/317 |
| 7,243,773 | B2 | 7/2007 | Bochonok et al. | 194/350 |
| 7,269,279 | B2 | 9/2007 | Chiles | 382/135 |
| 7,303,119 | B2 | 12/2007 | Molbak | 235/379 |
| 7,331,521 | B2 | 2/2008 | Sorenson et al. | 235/381 |
| 7,337,890 | B2 | 3/2008 | Bochonok et al. | 194/353 |
| 7,427,230 | B2 | 9/2008 | Blake et al. | 453/63 |
| 7,438,172 | B2 | 10/2008 | Long et al. | 194/347 |
| 7,464,802 | B2 | 12/2008 | Gerrity et al. | 194/347 |
| 7,500,568 | B2 | 3/2009 | Cousin | 209/534 |
| 7,520,374 | B2 | 4/2009 | Martin et al. | 194/317 |
| 7,551,764 | B2 | 6/2009 | Chiles et al. | 382/135 |
| 7,552,810 | B2 | 6/2009 | Mecklenburg | 194/317 |
| 7,580,859 | B2 | 8/2009 | Economy et al. | 705/16 |
| 7,654,450 | B2 | 2/2010 | Mateen et al. | 235/379 |
| 7,658,270 | B2 | 2/2010 | Bochonok et al. | 194/350 |
| 7,743,902 | B2 | 6/2010 | Wendell et al. | 194/302 |
| 7,778,456 | B2 | 8/2010 | Jones et al. | 382/135 |
| 7,819,308 | B2 | 10/2010 | Osterberg et al. | 235/379 |
| 7,874,478 | B2 | 1/2011 | Molbak | 235/379 |
| 7,886,980 | B2 | 2/2011 | Nishimura et al. | 194/347 |
| 7,931,304 | B2 | 4/2011 | Brown et al. | 283/57 |
| 7,946,406 | B2 | 5/2011 | Blake et al. | 194/200 |
| 7,963,382 | B2 | 6/2011 | Wendell et al. | 194/302 |
| 7,980,378 | B2 | 7/2011 | Jones et al. | 194/217 |
| 8,023,715 | B2 | 9/2011 | Jones et al. | 382/135 |
| 8,042,732 | B2 | 10/2011 | Blake et al. | 235/375 |
| 8,229,821 | B2 | 7/2012 | Mennie et al. | 232/16 |
| 2001/0034203 | A1 | 10/2001 | Geib et al. | 453/3 |
| 2001/0048025 | A1 | 12/2001 | Shinn | 235/382 |
| 2002/0065033 | A1 | 5/2002 | Geib et al. | 453/3 |
| 2002/0069104 | A1 | 6/2002 | Beach et al. | 705/14 |
| 2002/0074209 | A1 | 6/2002 | Karlsson | 194/330 |
| 2002/0095587 | A1 | 7/2002 | Doyle et al. | 713/186 |
| 2002/0107738 | A1 | 8/2002 | Beach et al. | 705/14 |
| 2002/0126885 | A1 | 9/2002 | Mennie et al. | 382/135 |
| 2002/0130011 | A1 | 9/2002 | Casanova et al. | 194/344 |
| 2002/0147588 | A1 | 10/2002 | Davis et al. | 704/246 |
| 2002/0151267 | A1 | 10/2002 | Kuhlin et al. | 453/3 |
| 2002/0174348 | A1 | 11/2002 | Ting | 713/186 |
| 2002/0179401 | A1 | 12/2002 | Knox et al. | 194/217 |
| 2003/0004878 | A1 | 1/2003 | Akutsu et al. | 705/43 |
| 2003/0013403 | A1 | 1/2003 | Blake et al. | 453/60 |
| 2003/0081824 | A1 | 5/2003 | Mennie et al. | 382/135 |
| 2003/0127299 | A1 | 7/2003 | Jones et al. | 194/217 |
| 2003/0168309 | A1 | 9/2003 | Geib et al. | 194/302 |
| 2003/0168310 | A1 | 9/2003 | Strauts et al. | 194/302 |
| 2003/0182217 | A1 | 9/2003 | Chiles | 705/35 |
| 2003/0190882 | A1 | 10/2003 | Blake et al. | 453/63 |
| 2003/0234153 | A1 | 12/2003 | Blake et al. | 194/347 |
| 2004/0055902 | A1 | 3/2004 | Peklo | 206/0.815 |
| 2004/0092222 | A1 | 5/2004 | Kowalczyk et al. | 453/12 |
| 2004/0153406 | A1 | 8/2004 | Alarcon-Luther et al. | 705/41 |
| 2004/0153421 | A1 | 8/2004 | Robinson | 705/75 |
| 2004/0154899 | A1 | 8/2004 | Peklo et al. | 193/33 |
| 2004/0173432 | A1 | 9/2004 | Jones | 194/216 |
| 2004/0188221 | A1 | 9/2004 | Carter | 194/215 |
| 2004/0200691 | A1 | 10/2004 | Geib et al. | 194/302 |
| 2004/0231956 | A1* | 11/2004 | Adams et al. | 194/217 |
| 2004/0256197 | A1 | 12/2004 | Blake et al. | 194/350 |
| 2005/0006197 | A1 | 1/2005 | Wendell et al. | 194/302 |
| 2005/0035140 | A1 | 2/2005 | Carter | 221/195 |
| 2005/0040007 | A1 | 2/2005 | Geib et al. | 194/302 |
| 2005/0040225 | A1 | 2/2005 | Csulits et al. | 235/379 |
| 2005/0045450 | A1 | 3/2005 | Geib et al. | 194/318 |
| 2005/0067305 | A1 | 3/2005 | Bochonok et al. | 206/8 |
| 2005/0077142 | A1 | 4/2005 | Tam et al. | 194/217 |
| 2005/0087425 | A1 | 4/2005 | Peklo | 194/350 |
| 2005/0108165 | A1 | 5/2005 | Jones et al. | 705/43 |
| 2005/0109836 | A1 | 5/2005 | Ben-Aissa | 235/380 |
| 2005/0124407 | A1 | 6/2005 | Rowe | 463/25 |
| 2005/0156318 | A1 | 7/2005 | Douglas | 257/761 |
| 2005/0176361 | A1* | 8/2005 | Quattrini et al. | 453/62 |
| 2005/0205654 | A1 | 9/2005 | Carter | 235/7 R |
| 2005/0205655 | A1 | 9/2005 | Carter | 235/7 R |
| 2005/0228717 | A1 | 10/2005 | Gusler et al. | 705/14 |
| 2005/0256792 | A1 | 11/2005 | Shimizu et al. | 705/35 |
| 2006/0037835 | A1 | 2/2006 | Doran et al. | 194/302 |
| 2006/0054455 | A1 | 3/2006 | Kuykendall et al. | 194/217 |
| 2006/0054457 | A1 | 3/2006 | Long et al. | 194/347 |
| 2006/0060363 | A2 | 3/2006 | Carter | 172/111 |
| 2006/0064379 | A1 | 3/2006 | Doran et al. | 705/42 |
| 2006/0069654 | A1 | 3/2006 | Beach et al. | 705/65 |
| 2006/0148394 | A1 | 7/2006 | Blake et al. | 453/12 |
| 2006/0149415 | A1 | 7/2006 | Richards | 700/236 |
| 2006/0151285 | A1 | 7/2006 | String | 194/350 |
| 2006/0154589 | A1 | 7/2006 | String | 453/11 |
| 2006/0175176 | A1 | 8/2006 | Blake | 194/216 |
| 2006/0182330 | A1 | 8/2006 | Chiles | 382/135 |
| 2006/0196754 | A1 | 9/2006 | Bochonok et al. | 194/347 |
| 2006/0205481 | A1 | 9/2006 | Dominelli | 463/25 |
| 2006/0207856 | A1 | 9/2006 | Dean et al. | 194/302 |
| 2006/0219519 | A1 | 10/2006 | Molbak et al. | 194/346 |
| 2007/0051582 | A1 | 3/2007 | Bochonok et al. | 194/202 |
| 2007/0071302 | A1 | 3/2007 | Jones et al. | 382/135 |
| 2007/0108015 | A1 | 5/2007 | Bochonok et al. | 194/350 |
| 2007/0119681 | A1 | 5/2007 | Blake et al. | 194/215 |
| 2007/0181676 | A1 | 8/2007 | Mateen et al. | 235/381 |
| 2007/0187494 | A1 | 8/2007 | Hanna | 235/383 |
| 2007/0221470 | A1 | 9/2007 | Mennie et al. | 194/216 |
| 2007/0269097 | A1 | 11/2007 | Chiles et al. | 382/135 |
| 2008/0033829 | A1 | 2/2008 | Mennie et al. | 705/16 |
| 2008/0044077 | A1 | 2/2008 | Mennie et al. | 382/135 |
| 2008/0220707 | A1 | 9/2008 | Jones et al. | 453/2 |
| 2009/0018959 | A1 | 1/2009 | Doran et al. | 705/44 |
| 2009/0236200 | A1 | 9/2009 | Hallowell et al. | 194/215 |
| 2009/0236201 | A1 | 9/2009 | Blake et al. | 194/215 |
| 2009/0239459 | A1 | 9/2009 | Watts et al. | 453/18 |
| 2009/0242626 | A1 | 10/2009 | Jones et al. | 235/379 |
| 2009/0320106 | A1 | 12/2009 | Jones et al. | 726/5 |
| 2010/0038419 | A1 | 2/2010 | Blake et al. | 235/379 |
| 2010/0198726 | A1 | 8/2010 | Doran et al. | 705/41 |
| 2010/0261421 | A1 | 10/2010 | Wendell et al. | 453/4 |
| 2010/0276485 | A1 | 11/2010 | Jones et al. | 235/379 |
| 2010/0327005 | A1 | 12/2010 | Martin et al. | 221/98 |
| 2011/0098845 | A1 | 4/2011 | Blake et al. | 700/223 |
| 2011/0099105 | A1 | 4/2011 | Mennie et al. | 705/41 |
| 2011/0270695 | A1 | 11/2011 | Jones et al. | 705/43 |
| 2012/0067950 | A1 | 3/2012 | Blake et al. | 235/381 |
| 2012/0156976 | A1 | 6/2012 | Blake et al. | 453/4 |

FOREIGN PATENT DOCUMENTS

| | | | |
|---|---|---|---|
| CA | 2143943 | C | 3/2003 |
| DE | 06 60 354 | | 5/1938 |
| DE | 30 21 327 | A1 | 12/1981 |
| EP | 0 351 217 | A2 | 1/1990 |
| EP | 0 667 973 | B1 | 1/1997 |
| EP | 0 926 634 | A2 | 6/1999 |
| EP | 1 104 920 | A1 | 6/2001 |
| EP | 1 209 639 | A2 | 5/2002 |
| EP | 1 528 513 | A1 | 5/2005 |
| FR | 2042254 | | 2/1971 |
| GB | 2035642 | A | 6/1980 |
| GB | 2175427 | A | 11/1986 |
| GB | 2198274 | A | 6/1988 |
| GB | 2458387 | A | 9/2009 |
| GB | 2468783 | A | 9/2010 |
| JP | 49-058899 | | 6/1974 |
| JP | 52-014495 | | 2/1977 |
| JP | 52-071300 | A | 6/1977 |

| | | | |
|---|---|---|---|
| JP | 56-040992 | A | 4/1981 |
| JP | 57-117080 | A | 7/1982 |
| JP | 59-079392 | A | 5/1984 |
| JP | 60-016271 | U | 2/1985 |
| JP | 62-134168 | U | 8/1987 |
| JP | 62-182995 | A | 8/1987 |
| JP | 62-221773 | A | 9/1987 |
| JP | 62-166562 | U | 10/1987 |
| JP | 64-035683 | A | 2/1989 |
| JP | 64-042789 | A | 2/1989 |
| JP | 64-067698 | A | 3/1989 |
| JP | 01-118995 | A | 5/1989 |
| JP | 01-307891 | A | 12/1989 |
| JP | 02-050793 | A | 2/1990 |
| JP | 02-252096 | A | 10/1990 |
| JP | 03-012776 | A | 1/1991 |
| JP | 03-063795 | A | 3/1991 |
| JP | 03-092994 | A | 4/1991 |
| JP | 03-156673 | A | 7/1991 |
| JP | 04-085695 | A | 3/1992 |
| JP | 04-175993 | A | 6/1992 |
| JP | 05-046839 | A | 2/1993 |
| JP | 05-217048 | A | 8/1993 |
| JP | 05-274527 | A | 10/1993 |
| JP | 06-035946 | A | 2/1994 |
| JP | 06-103285 | A | 4/1994 |
| JP | 09-251566 | A | 9/1997 |
| JP | 2002-117439 | A | 4/2002 |
| JP | 2003-242287 | A | 8/2003 |
| JP | 2004-213188 | A | 7/2004 |
| SE | 44 244 | | 9/1988 |
| WO | WO 85/00909 | A1 | 2/1985 |
| WO | WO 91/06927 | A1 | 5/1991 |
| WO | WO 91/08952 | A1 | 6/1991 |
| WO | WO 91/12594 | A1 | 8/1991 |
| WO | WO 91/18371 | A1 | 11/1991 |
| WO | WO 92/08212 | A1 | 5/1992 |
| WO | WO 92/20043 | A1 | 11/1992 |
| WO | WO 92/20044 | A1 | 11/1992 |
| WO | WO 92/22044 | A1 | 12/1992 |
| WO | WO 93/00660 | A1 | 1/1993 |
| WO | WO 93/09621 | A1 | 5/1993 |
| WO | WO 94/06101 | A1 | 3/1994 |
| WO | WO 94/08319 | A1 | 4/1994 |
| WO | WO 94/23397 | A1 | 10/1994 |
| WO | WO 95/02226 | A1 | 1/1995 |
| WO | WO 95/04978 | A1 | 2/1995 |
| WO | WO 95/06920 | A1 | 3/1995 |
| WO | WO 95/09406 | A1 | 4/1995 |
| WO | WO 95/13596 | A1 | 5/1995 |
| WO | WO 95/19017 | A1 | 7/1995 |
| WO | WO 95/23387 | A1 | 8/1995 |
| WO | WO 95/30215 | A1 | 11/1995 |
| WO | WO 96/07163 | A1 | 3/1996 |
| WO | WO 96/07990 | A1 | 3/1996 |
| WO | WO 96/12253 | A1 | 4/1996 |
| WO | WO 96/27525 | A1 | 9/1996 |
| WO | WO 96/27859 | A1 | 9/1996 |
| WO | WO 97/22919 | A1 | 6/1997 |
| WO | WO 97/25692 | A1 | 7/1997 |
| WO | WO 98/24041 | A1 | 6/1998 |
| WO | WO 98/24067 | A1 | 6/1998 |
| WO | WO 98/48383 | A2 | 10/1998 |
| WO | WO 98/48384 | A2 | 10/1998 |
| WO | WO 98/48385 | A2 | 10/1998 |
| WO | WO 98/51082 | A1 | 11/1998 |
| WO | WO 98/59323 | A1 | 12/1998 |
| WO | WO 99/00776 | A1 | 1/1999 |
| WO | WO 99/06937 | A1 | 2/1999 |
| WO | WO 99/16027 | A2 | 4/1999 |
| WO | WO 99/33030 | A1 | 7/1999 |
| WO | WO 99/41695 | A1 | 8/1999 |
| WO | WO 99/48057 | A1 | 9/1999 |
| WO | WO 99/48058 | A1 | 9/1999 |
| WO | WO 00/48911 | A1 | 8/2000 |
| WO | WO 00/65546 | A1 | 11/2000 |
| WO | WO 01/63565 | A2 | 8/2001 |
| WO | WO 02/071343 | A1 | 9/2002 |
| WO | WO 03/052700 | A2 | 6/2003 |
| WO | WO 03/079300 | A1 | 9/2003 |
| WO | WO 03/085610 | A1 | 10/2003 |
| WO | WO 03/107280 | A2 | 12/2003 |
| WO | WO 2004/044853 | A1 | 5/2004 |
| WO | WO 2004/109464 | A2 | 12/2004 |
| WO | WO 2005/041134 | A2 | 5/2005 |
| WO | WO 2005/088563 | A1 | 9/2005 |
| WO | WO 2006/086531 | A1 | 8/2006 |
| WO | WO 2007/035420 | A2 | 3/2007 |
| WO | WO 2007/120825 | A2 | 10/2007 |

OTHER PUBLICATIONS

Press Release—Telequip Develops a Coin Loading Solution—(Apr. 29, 2004 ) 2 pages.

Features Sheet for CoinStream™ Self-Service Mixed Coin Output Systems; Self Service Coin.com by Magner © 2005, 2 pages.

Telequip Coin Dispenser Canister Loading Device Instruction Manual (undated) 2 pages.

HM-4 Coin Hopper Product Information Sheet (undated) 1 page.

Amid Industries: AI-1500 'Pulsar' High Performance Sorting and Bagging Machine, 13 pages (date unknown, but prior to Dec. 14, 2000).

AUI: Coinverter —"No More Lines . . . Self-Serve Cash-Out," by Cassius Elston, 1995 World Games Congress/Exposition Converter, 1 page (dated prior to 1995).

Brandt: 95 Series Coin Sorter Counter, 2 pages (1982).

Brandt: Model 817 Automated Coin and Currency Ordering System, 2 pages (1983).

Brandt: Model 920/925 Counter, 2 pages (date unknown, prior to Jul. 2011, possibly prior to Mar. 17, 1997).

Brandt: System 930 Electric Counter/Sorter, "Solving Problems, Pleasing Customer, Building Deposits," 1 page (date unknown, prior to Mar. 2, 2011, possibly prior to Mar. 17, 1997).

Brandt: Model 940-6 High Speed Sorter/Counter, 2 pages (date unknown, prior to Oct. 31, 1989).

Brandt: System 945 High-Speed Sorter, 2 pages (date unknown, prior to Mar. 2, 2011, possibly prior to Mar. 17, 1997).

Brandt: Model 952 Coin Sorter/Counter, 2 pages (date unknown, prior to Oct. 31, 1989).

Brandt: Model 954 Coin Sorter/Counter, 2 pages (date unknown, prior to Oct. 31, 1989).

Brandt: Model 957 Coin Sorter/Counter, 2 pages (date unknown, prior to Oct. 31, 1989).

Brandt: Model 958 Coin Sorter/Counter, 5 pages (©1982).

Brandt: Model 960 High-Speed Coin Sorter & Counter, 2 pages (1984).

Brandt; Model 966 Microsort™ Coin Sorter and Counter, 4 pages, (1979).

Brandt: Model 970 Coin Sorter and Counter, 2 pages (1983).

Brandt: Model 1205 Coin Sorter Counter, 2 pages (1986).

Brandt: Model 1400 Coin Sorter Counter, 2 pages (date unknown, prior to Mar. 2, 2011, possibly prior to Mar. 17, 1997).

Brandt: Model 8904 Upfeed —"High Speed 4-Denomination Currency Dispenser," 2 pages (1989).

Brandt: Mach 7 High-Speed Coin Sorter/Counter, 2 pages (1992).

Case ICC Limited: CDS Automated Receipt Giving Cash Deposit System, 3 pages (date unknown, prior to Nov. 15, 2000).

Cash, Martin: Newspaper Article "Bank Blends New Technology With Service," Winnipeg Free Press, 1 page (Sep. 4, 1992).

Childers Corporation: Computerized Sorter/Counter, "To coin an old adage, time is money . . ,"3 pages (1981).

CTcoin: CDS602 Cash Deposit System, 1 page date unknown, prior to Jan. 15, 2001).

Cummins: Cash Information and Settlement Systems (Form 023-1408), 4 pages (date Dec. 1991).

Cummins: The Universal Solution to All Coin and Currency Processing Needs (Form 13C1218 3-83), 1 page (Mar. 1983).

Cummins: JetSort® High Speed Sorter/Counter Kits I & J —Operating Instructions (Form 022-7123-00) 12 page (1994).

Cummins: JetSort® Coin Sorter Counter/CA-130XL Coin Wrapper, Cummins Automated Money Systems (AMS) Case Study —Fifth-Third, "6,000 Coin Per Minute Counter/Sorter Keeps pace With Fifth-Third Bank's Money Processing Needs," (Form 13C1180), 2 pages (Nov. 1981).
Cummins: JetSort®, "Venders Love JetSort," (13C1255), 1 page (Mar. 1987).
Cummins: JetSort® "High Speed Coin Sorter & Counter for Payphone Applications," "CTOCS Ready" (Form 023-1365), 2 pages (Mar. 1989).
Cummins: JetSort® mailer, "One moving part simplicity," "Vendors —Are validators changing your coin and currency needs?" (Form 023-1297), 3 pages (Apr. 1987).
Cummins: JetSort® Series V High Speed Coin Sorter/Counter, (Form 023-1383), 2 pages (Sep. 1990).
Cummins: JetSort® "Time for a Change, Be a smashing success!," (Form 023-1328), 1 page (Jun. 1988).
Cummins: JetSort® "Time for a Change —JetSort® vs. Brandt X," (Form 023-1330), 1 page (Jun. 1988).
Cummins: JetSort® "Time for a Change—No Coins Sorted After 3:00 or on Saturday," (Form 023-1327), 1 page (Aug. 1988).
Cummins: JetSort®, "What do all these Banks have in Common . . . ?", JetSort, CA-130XL coin wrapper, CA-118 coin wrapper, CA-4000 JetCount, (13C1203), 3 pages (Aug. 1982).
Cummins: JetSort® 700-01/CA-118 Coin Wrapper, Cummins Automated Money Systems (AMS) Case Study —University State Bank, "Cummins Money Processing System Boosts Teller Service at University State Bank," (Form 13C1192), 2 pages (Mar. 1982).
Cummins: JetSort® 700-01, Cummins Automated Money Systems (AMS) Case Study —First State Bank of Oregon, "JetSort® Gives Bank Coin Service Edge," (Form 13C1196), 2 pages (Apr. 1982).
Cummins: JetSort® 700-01 Coin Sorter/Counter, Operating Instructions, 14 pages (1982).
Cummins: JetSort® 701, Cummins Automated Money Systems (AMS) Case Study —Convenco Vending, "High Speed Coin Sorter increases coin processing power at Convenco Vending," (Form 13C1226), 2 pages (Jul. 1983).
Cummins: JetSort Models 701 and 750 , "State-of-the-art coin processing comes of age," 2 pages (Feb. 1982).
Cummins: JetSort® Model CA-750 Coin Processor (Item No. 50-152), 1 page (Jul. 1984).
Cummins: JetSort® Model CA-750 Coin Sorter/Counter and CA-4050 JetCount currency counter, "Money Processing Made Easy," (Form 13C1221) 2 pages (Jun. 1983).
Cummins: JetSort® Model 1701 with JetStops, Operating Instructions Manual (Form 022-1329-00), 16 pages (1984).
Cummins: JetSort® Model 1760 brochure, (Form 023-1262-00), 2 pages (Jul. 1985).
Cummins: JetSort® Models 1770 and 3000, Communication Package specification and operating instructions, 10 pages (uncertain, possibly Nov. 1985).
Cummins: JetSort® Model 1770, "JetSort® Speed and Accuracy, Now with Communications!", (Form 023-1272) 1 page (Oct. 1986).
Cummins: JetSort® 2000 Series High Speed Coin Sorter/Counter (Form 023-1488), 2 pages (Oct. 2000).
Cummins: JetSort®3000 Series High Speed Coin Sorter (Form 023-1468 Rev 1), 2 pages (Feb. 1995).
Cummins: JetSort®3000 Series Options, "Talking JetSort 3000," (Form 023-1338-00), 1 page (between Jan. 1989-Feb. 1989).
Cummins: JetSort®3000, "3,000 Coins per Minute!," (Form 023-1312), 1 page (date unknown, est. 1987).
Cummins: JetSort®3200, Enhanced electronics for the JetSort® 3200 (Form 023-1350), 1 page (Apr. 1987).
De La Rue: CDS 500 Cash Deponier System, 6 pages (date unknown, p. 5 has date May 1994, p. 6 has date Dec. 1992) (German).
De La Rue: Cds 5700 and CDS 5800 Cash Deponier System (German) and translation, 7 pages (date unknown, prior to Aug. 13, 1996).
Diebold: Merchant MicroBranch, "Merchant MicroBranch Combines ATM After-Hour Depository Rolled-Coin Dispenser," Bank Technology News, 1 page (Nov. 1997).
Fa. GBS—Geldbearbeitungssysteme: GBS9401SB Technical Specification, 24 pages (date unknown, prior to Nov. 10, 2010).
Frisco Bay: Commercial Kiosk, "Provide self-service solutions for your business customers," 4 pages (date unknown, prior to Mar. 2, 2011, p. 4 has date 1996).
Glory: AMT Automated Merchant Teller, 4 pages (date unknown, prior to Jan. 15, 2001).
Glory: CRS-8000 Cash Redemption System, 2 pages (1996).
Hamilton: Hamilton's Express Banking Center, in Less Space Than a Branch Manager's Desk, 4 pages (date unknown, prior to Jan. 15, 2001).
ISH Electronic: ISH 12005/500 Coin Counter (with translation), 4 pages (date unknown, prior to Aug. 1996).
ISH Electronic: ISH 12005/501 Self-Service Unit (with translation), 4 pages (date unknown, prior to Aug. 1996).
Namsys, Inc.: Namsys Express, Making currency management . . . more profitable, 2 pages (date unknown, prior to Jan. 15, 2001).
NGZ Geldzahlmaschinengesellschaft: NGZ 2100 Automated Coin Depository, 4 pages (date unknown, prior to Sep. 1996).
Perconta: Contomat Coin Settlement Machine for Customer Self Service, 2 pages (date unknown, prior to Apr. 2003).
Prema GmbH: Prema 405 (RE) Self Service Coin Deposit Facility, 2 pages (date unknown, prior to Apr. 2003).
Reis Eurosystems: CRS 6501/CRS 6510 Cash Receipt Systems for Self-Service Area, 3 pages (date unknown, prior to Apr. 2003).
Reis Eurosystems: CRS 6520/ CRS 6525 Standard-Class Coin Deposit Systems, 1 page (date unknown, prior to Apr. 2003).
Reis Eurosystems: CS 3510 Disc-Sorter, 1 page (date unknown, prior to Apr. 2003).
Royal Bank: Hemeon, Jade, "Royal's Burlington drive-in bank provides customers 24-hour tellers," the Toronto Star, 1 page (Aug. 21, 1991).
Royal Bank: Leitch, Carolyn, "High-Tech Bank Counts Coins," The Globe and Mail, 2 pages (Sep. 19, 1991).
Royal Bank: Oxby, Murray, "Royal Bank Opens 'Super Branch,'" the Gazette Montreal, 2 pages (Sep. 14, 1991).
Royal Bank: SuperBranch, "Experience the Ultimate in Convenience Banking," 2 pages (Feb. 1992).
Scan Coin: International Report, 49 pages (Apr. 1987).
Scan Coin: Money Processing Systems, 8 pages (date unknown, prior to Apr. 2003).
Scan Coin: World, 2 pages (Feb. 1988).
Scan Coin: CDS Cash Deposit System, 6 pages (date unknown, prior to Apr. 2003) [SC 0369].
Scan Coin: CDS Coin Deposit System —Technical Referens Manual, 47 pages (1989).
Scan Coin: CDS 600 User's Manual, 14 pages (date unknown, prior to Apr. 2003).
Scan Coin: CDS 600 & CDS 640 Cash Deposit System —Technical Manual, 45 pages (date unknown, prior to Apr. 2003).
Scan Coin: CDS MK 1 Coin Deposit System —Technical Manual, 32 pages (1991).
Scan Coin: SC 102 Value Counter Technical Manual, 28 pages (date unknown, prior to Apr. 2003).
Pay by Touch: Secure ID News, "Piggly Wiggly Extends Biometric Payments Throughout the Southeast U.S.," 2 pages, (Dec. 14, 2005).
ESD, Inc: Smartrac Card System, "Coinless laundry makes quarters obsolete; Smartrac Card System really makes a change in laundry industry," Business Wire, 2 pages (Feb. 23, 1996).
Meece, Mickey: Article "Development Bank of Singapore Gets Cobranding Edge with Smart Cards," American Banker, New York, NY, vol. 159, Iss. 195, p. 37, 2 pages (Oct. 10, 1994).

* cited by examiner

SYSTEM, METHOD AND APPARATUS FOR AUTOMATICALLY FILLING A COIN CASSETTE

CROSS-REFERENCE TO RELATED APPLICATION

This application claims the benefit of the U.S. Provisional Application 60/610,050 filed on Sep. 15, 2004 and entitled "System, Method And Apparatus For Automatically Filling A Coin Cassette" and this provisional application is hereby incorporated by reference in its entirety.

FIELD OF THE INVENTION

This disclosure generally relates to coin tray or coin cassette refill devices.

BACKGROUND OF THE INVENTION

Coin dispenser trays are widely used as cashier/check out areas and in the self-service check out equipment typically found in places like supermarkets (e.g., Jewel/Osco) and Home Depot. A variety of coin dispensing trays or coin cassettes are provided by a number of manufacturers, each manufacturer possibly offering several tray models having different sizes, arrangements, volumes, denominations, and combinations of coin receptacles for receiving coins in various coin positions.

One common coin dispenser is the Asahi Seiko USA, Inc. (www.asusainc.com) HM-4 coin hopper, in which a plurality of hoppers (i.e., 1¢, 5¢, 25¢, $1.00) drop the coins into a single exit chute for delivery to a common coin cup. The HM-4 accepts an AMP drawer plug connection to simplify wiring and the hoppers each slide off of the main base plate to permit servicing of coin jams. As the hoppers are depleted, the cashiers or other designated personnel, fill the individual hoppers with coins.

Another popular conventional coin dispenser is the TELQUIP Transact 2+, which employs removable coin canister or cassette. The program software tracks the change being issued and optimizes the use of the coin supply by attempting to even out the distribution of the coins to enable a longer period of time between refills. The Transact 2+ provides a plug and play pre-wire installation with standard RS232 serial port and other register interfaces. TELQUIP advertises that the Transact 2+ enables vendors to save from 5 to 7 seconds on every transaction. However, despite these benefits, the refill operation of the TELQUIP $\text{Transact}_{CLS}$ must be done manually. To facilitate loading of the Transact 2+ coin canister, TELQUIP provides the $\text{Transact}_{CLS}$ (Canister Loading Solution), shown in FIG. 1. To use this manual device, one must first remove the clear plastic canister cover by depressing two tabs 70 at the bottom and sliding up until the canister handle hangs toward the back of the canister. Then, the canister stand 10 is placed on a flat surface and the canister 20 assembled to the stand by sliding it down onto two rails 60. The canister loading device 30 is then attached to the canister by lowering the device onto the canister, engaging the top rear of the canister, then pivoting the bottom of the loading device inwardly to engage the front of the canister. The canister loading device 30 is then slid down until it engages the taps at the base of the canister stand.

If the funnel retainer 40 is not already assembled onto the loading device, it is slid onto the two rails at the top of the loading device. The funnel 50 is then attached to the funnel retainer 40 by dropping the funnel onto the retainer with the slots aligned. The funnel 50 is then rotated ¼ turn clockwise, positioned with the opening 52 in the front and the "nose" 54 in the back. To manually position the funnel over the appropriate denomination, the funnel must be lifted slightly and slid until positioned over the appropriate column at which time the funnel is dropped in place so that the shoulder 56 of the funnel is flush with the retainer 40. At this point, the person performing the filling operation must begin loading coins for that denomination by slowly pouring coins into the funnel either by hand, cup, or directly from the coin bag. They must continue filling until that column is filled to the desired height indicated by the calibration strips on the canister. This work is tedious, time consuming, and must be repeated for each denomination.

Despite the advances realized by the aforementioned technology, there remains room for additional improvements to the technology to improve the speed with which coin hoppers and coin canisters may be refilled and returned to service.

SUMMARY

According to one aspect, an automated coin tray refilling system includes a processor, a plurality of coin reservoirs, and a plurality of coin dispensers for regulating the dispensing of coins from an associated one of the plurality of coin reservoirs. A collector point distribution member is adapted to receive coins from each of the plurality of coin dispensers at one portion thereof and to output the coins at another portion thereof. An interface module having an input end is disposed substantially adjacent the collector point distribution member output and includes an output end for dispensing coins. A coin interface tray is adapted to receive at least one coin tray. The interface module and/or coin interface tray includes a drive system configured to move interface module and/or coin interface tray relative to one another.

In another aspect, an automated coin tray refilling system comprises an interface module having an input end adapted to receive coins from a coin source and a variably configurable output end, the variably configurable output end including at least one movable member to adjust a configuration of the output end, for dispensing coins and a coin interface tray adapted to receive at least one coin tray of a predetermined plurality of coin trays. The interface module movable member is adjustable to facilitate coin placement within any one of the predetermined plurality of coin trays.

In still another aspect, an automated coin tray refilling system comprises/an interface module having an input end adapted to receive coins from a coin source and an output end for dispensing coins and a coin interface tray adapted to receive at least one coin tray. At least one processor is provided and the interface module and/or coin interface tray includes a drive system operatively associated with the processor and configured to move a respective one of the interface module and coin interface tray relative to the other one of the interface module and coin interface tray.

In yet another aspect, an automated coin tray refilling system comprises a plurality of coin reservoirs, each coin reservoir adapted to receive a coin of a predetermined denomination and a plurality of coin dispensers, each coin dispenser regulating the dispensing of coins from an associated one of the plurality of coin reservoirs. A collector point distribution member is adapted to receive coins from each of the plurality of coin dispensers at one portion thereof and to output the coins at another portion thereof and an interface module is provided with an input end disposed substantially adjacent an outlet end of the collector point distribution member and having an output end for dispensing coins. A coin tray is disposed adjacent the output end of the interface module, the coin tray having a plurality of coin channels, each coin channel configured to receive a coin of a predetermined denomination. A coin reading sensor is provided adjacent the coin tray to sense the degree to which each of the coin tray coin channels are filled and outputting a signal related thereto. A processor controller configured to receive a signal output from the coin reading sensor and to output a signal to a respective one of the plurality of coin dispensers to cause that coin dispenser to dispense coins from an associated one of the plurality of coin reservoirs.

Additional advantages of the present concepts will become readily apparent to those skilled in this art from the following detailed description, wherein only preferred aspects of the present concepts are shown and described, simply by way of illustration. As will be realized, the present invention is capable of other and different embodiments, and its details are capable of modifications in various obvious respects, all without departing from the disclosed concepts. Accordingly, the drawings and description are to be regarded as merely illustrative in nature, and are not to be regarded as limiting or restrictive on the broad aspects of the disclosure.

BRIEF DESCRIPTION OF THE DRAWINGS

The invention will be described in conjunction with the following drawings in which like reference numerals designate like elements and wherein.

Figure 1:
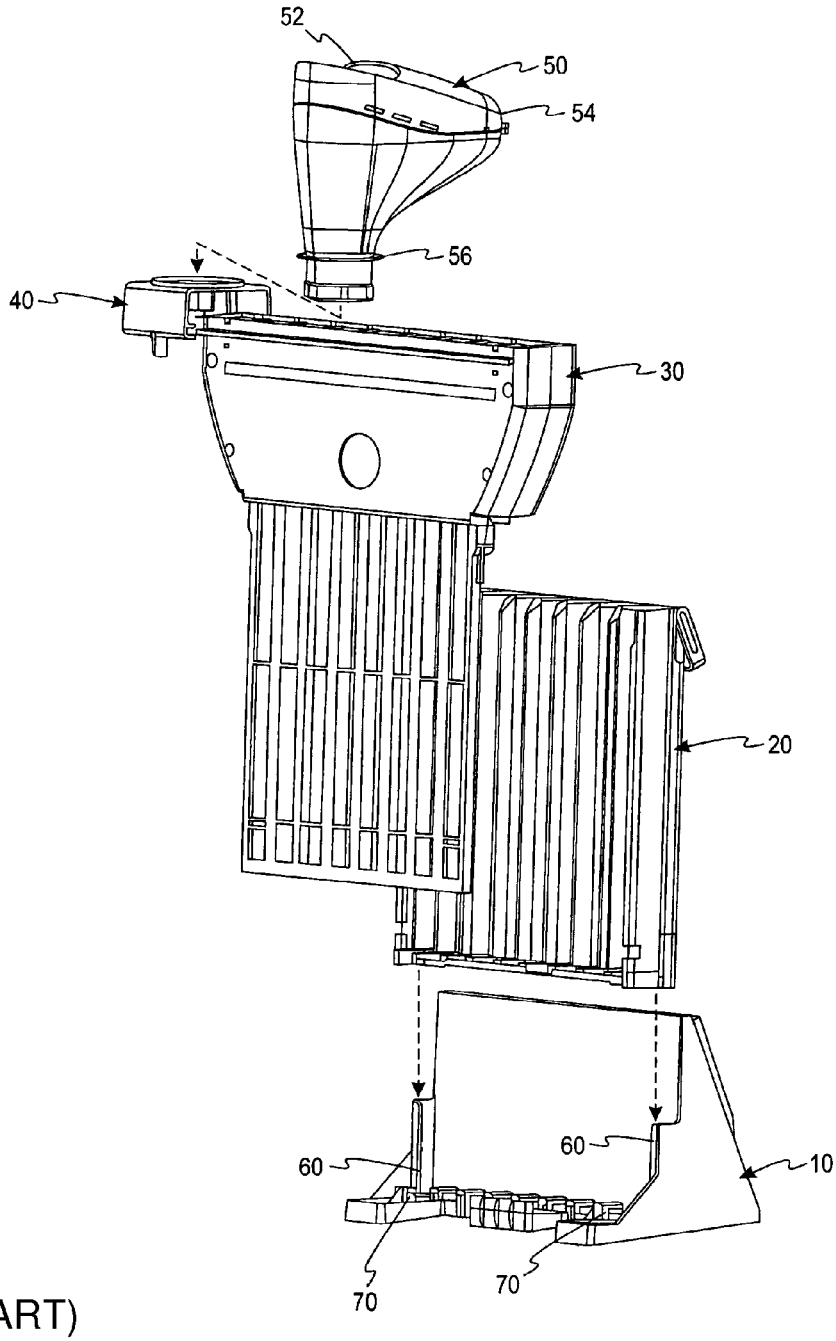
(PRIOR ART) Fig. 1
FIG. 1 depicts a TELQUIP Transact$_{CLS}$.
Figure 2A:
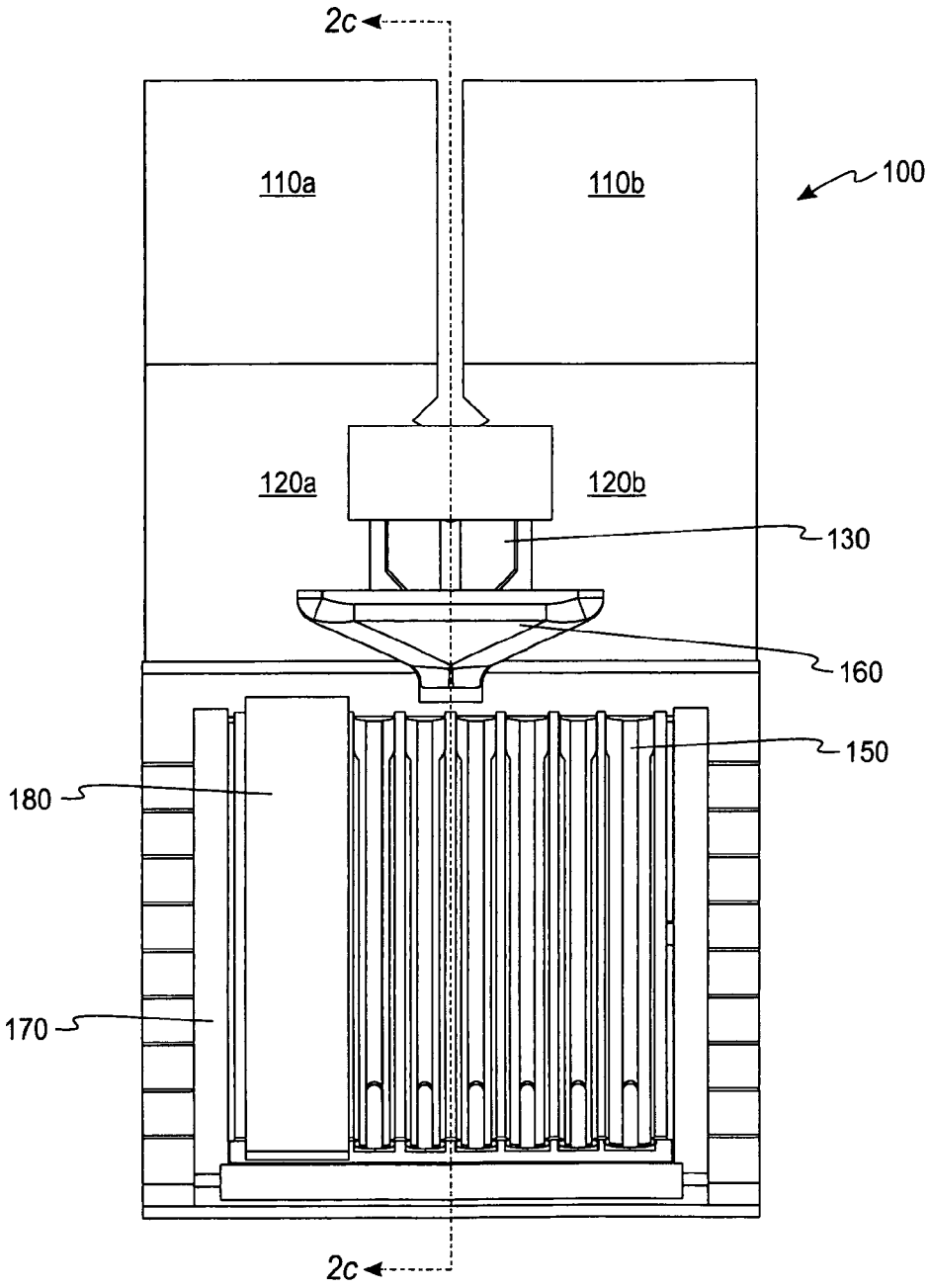
FIGS. 2(*a*)-(*d*) shows front, top, cross-sectional, and side views, respectively, of one system for automated refill of a coin tray in accord with the present disclosure.
Figure 2B:
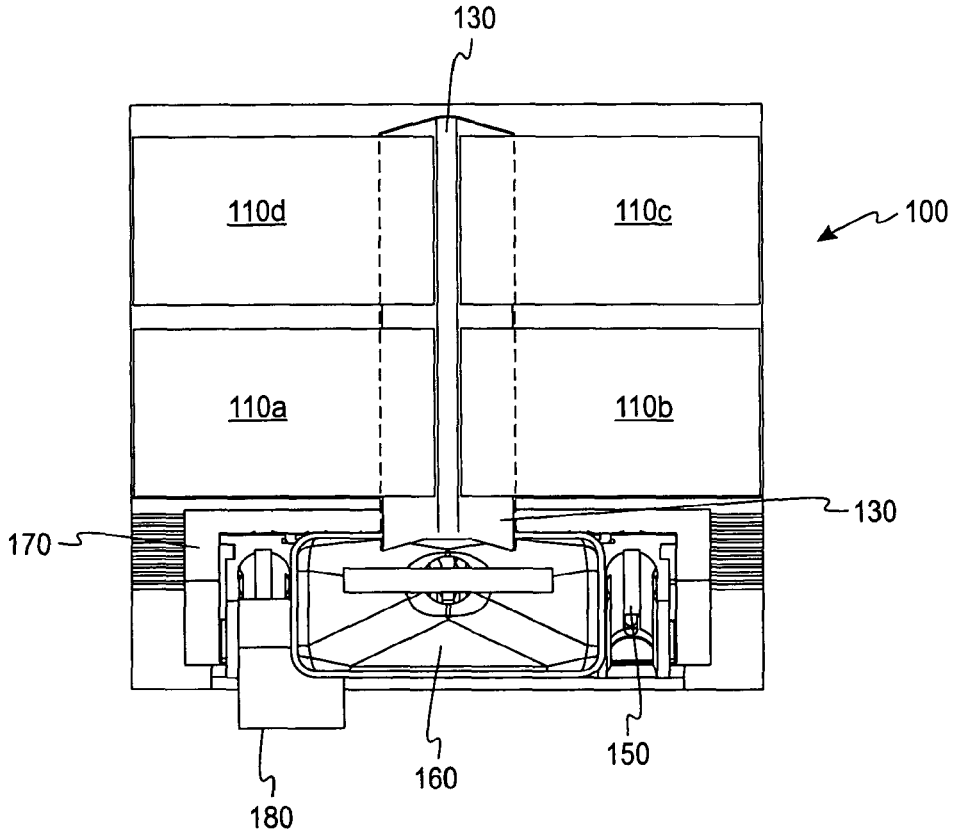
Figure 2C:
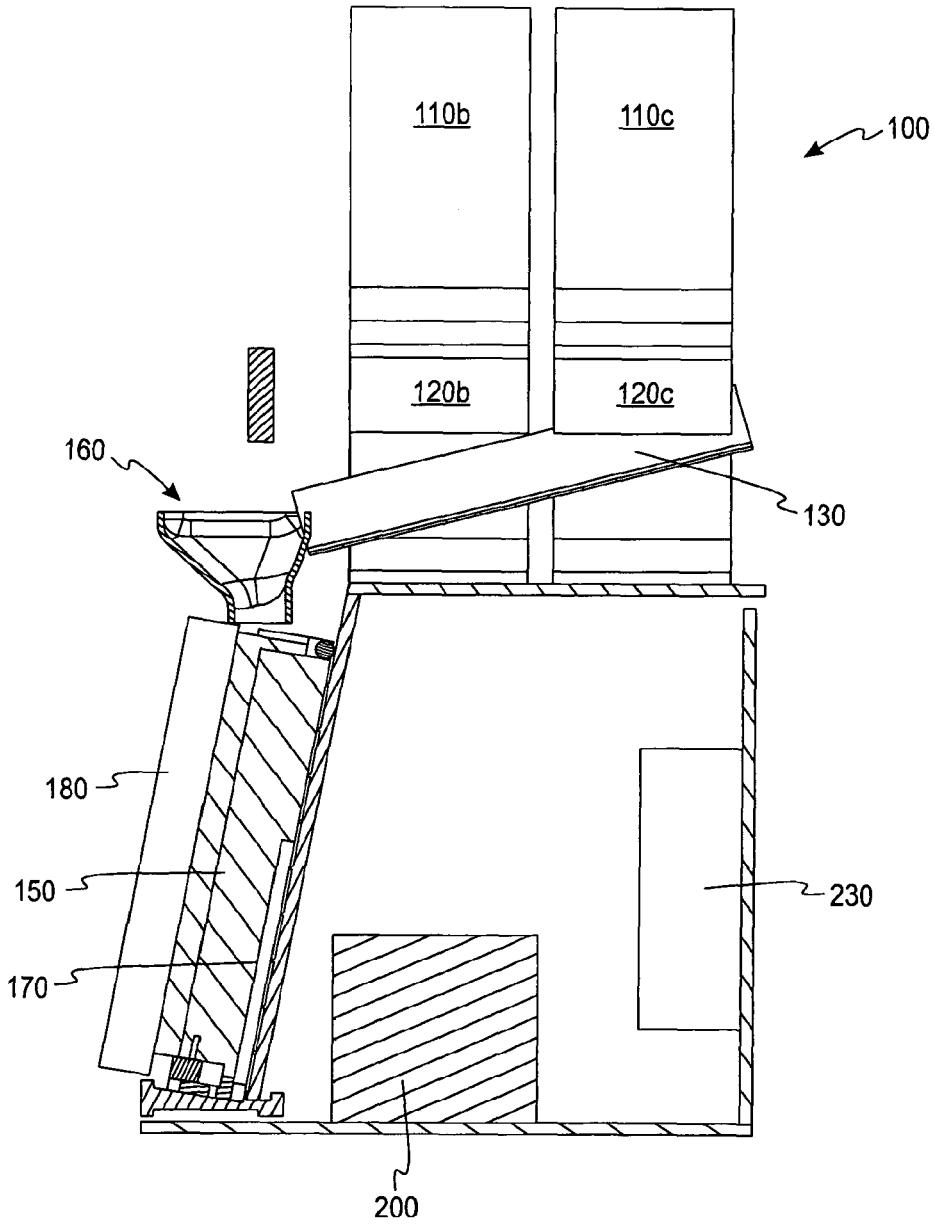
Figure 2D:
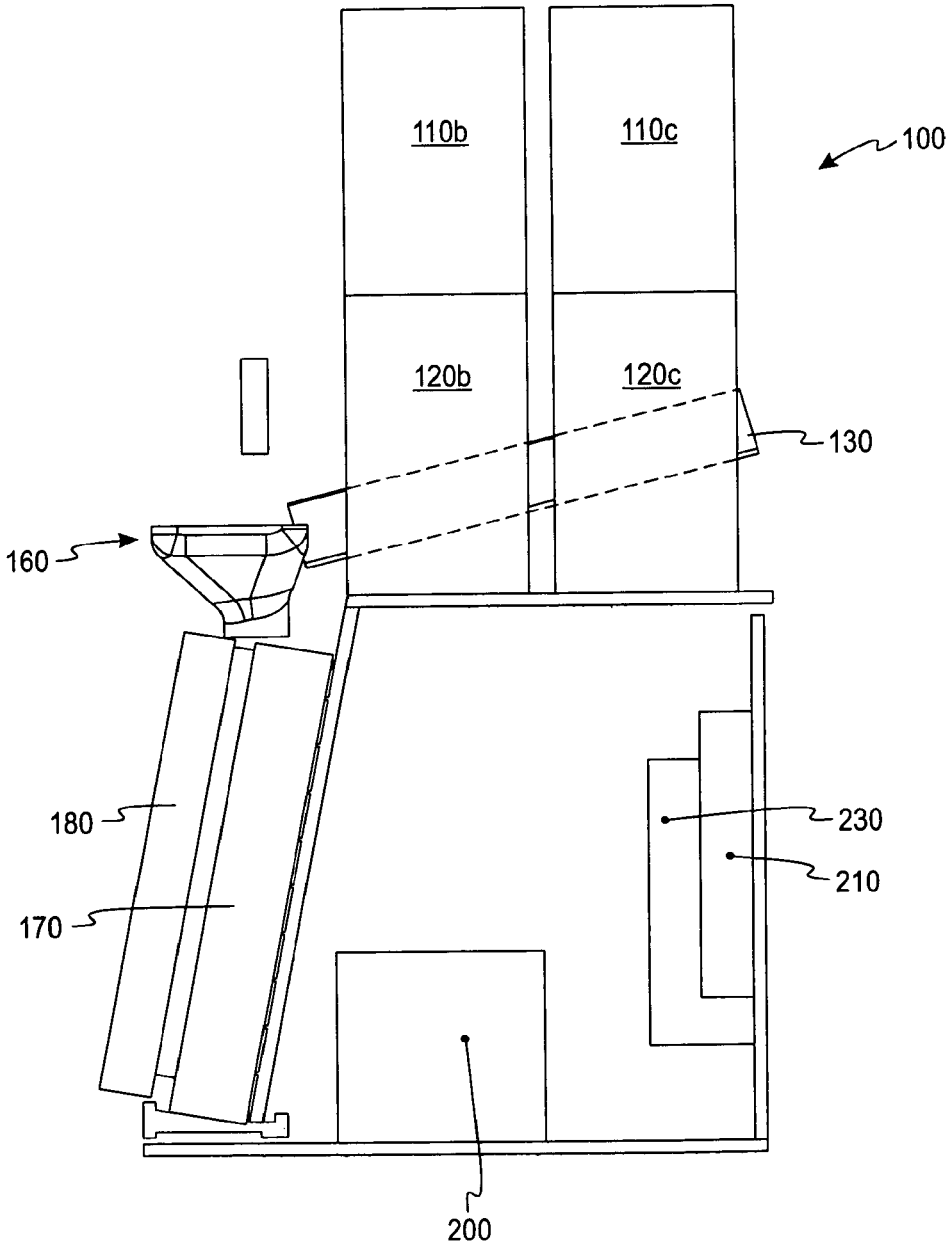

The appended drawings are not to scale are merely intended to convey a general sense of interrelation between components and systems.

DETAILED DESCRIPTION

The systems and subsystems defined below explore one approach to the development of an Automated Coin Tray Refill Device in accord with the present concepts. They are not intended to define the variety of possible solutions, but are merely exemplary of one preferred implementation of the disclosed concepts. The systems presented herein are intended to convey, to those skilled in the art, an appropriate level of detail to illustrate some of the possible functions involved and how they relate to the machine as a whole sufficient to enable them to make and/or use the concepts disclosed herein without undue experimentation.

FIGS. 2(*a*)-2(*d*) shows an example of an automated coin tray refill device or coin dispenser 100 in accord with the present concepts directed to an automated method of filling coin trays, cassettes, hoppers, bags, and canisters. Although the example of FIGS. 2(*a*)-2(*d*) depicts a coin dispenser 100 configured for use with the TELQUIP 2+ coin tray, the concepts herein are not limited to any one coin tray, cassette, canister, or bag.

The coin dispenser 100 generally comprises supports for individual coin dispensers 120*a*-120*d* and reservoirs 110*a*-110*d* and defines a housing to enclose components such as a power supply 230 and computer or processor 210. In one aspect, the power supply 230 and computer 210 could be external to the coin dispenser 100 and could be connected thereto using conventional electrical I/O connectors. A coin collector system is fed by the coin dispensers 120*a*-120*d* and outputs the coins input therein to a interface module 160 for output into a coin tray inserted into the coin dispenser 100, whether directly or through a coin interface tray or module 170. The interface module 160 and/or the coin interface tray 170 may be configured to translate, move, or rotate relative to one another to facilitate interface therebetween.

Power supply 230 is configured to interface with an available AC power supply and is configured to provide rated DC power to system components which may include, but are not limited to, interface module 160 actuators, sensors or drive systems, coin tray 150 actuators, sensors or drive systems, coin interface tray 170 actuators, sensors or drive systems, coin reader 180 actuators, sensors or drive systems, coin dispenser 120(*a*)-120(*d*) actuation devices or sensors, coin collector point distribution system 130 actuators, sensors or drive systems, display 190, computer or processor 210, and any attached memory devices (e.g., solid state memory, disk drive, CD-ROM drive, DVD-Drive, etc.) Computer 210 also includes a main memory, such as a random access memory (RAM) or other dynamic storage device, coupled to bus for storing information and instructions to be executed by a processor. The main memory also may be used for storing temporary variables or other intermediate information during execution of instructions to be executed by the processor. Computer 210 further includes a read only memory (ROM) or other static storage device coupled to the bus for storing static information and instructions for the processor. A storage device, such as a magnetic disk or optical disk, is preferably provided and coupled to bus for storing information and instructions.

Execution of sequences of instructions contained in main memory causes the processor or processors, if more than one is provided, to perform the actions described herein. In alternative embodiments, hard-wired circuitry or firmware may be used in place of or in combination with software instructions and it is to be understood that no specific combination of hardware circuitry, firmware, and software are required. Instructions may be provided in any number of forms such as source code, assembly code, object code, machine language, compressed or encrypted versions of the foregoing, and any and all equivalents thereof. "Computer-readable medium" refers to any medium that participates in providing instructions to the processor for execution and the term computer usable medium may be referred to as "bearing" the instructions, which encompass all ways in which instructions are associated with a computer usable medium. Computer-readable mediums include, but are not limited to, non-volatile media, volatile media, and transmission media. Non-volatile media include, for example, optical or magnetic disks. Volatile media include dynamic memory, such as main memory. Transmission media include coaxial cables, copper wire and fiber optics, including the wires that comprise bus 102. Transmission media can also take the form of acoustic or light waves, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, and EPROM, a FLASH-EPROM, any other memory chip or cartridge, a carrier wave as described hereinafter, or any other medium from which a computer can read.

Various forms of computer readable media may be involved in carrying one or more sequences of one or more instructions to processor for execution. For example, the instructions may initially be borne on a magnetic disk of a remote computer, which can transmit instructions to computer 210 over a telephone line using a modem or through a cable line or wireless signal. Computer 210 may also include a communication interface coupled to the bus to provide a two-way data communication coupling to a network link connected to a local network. For example, the communication interface may be an integrated services digital network (ISDN) card or a modem to provide a data communication connection to a corresponding type of telephone line. As another example, the communication interface may be a local area network (LAN) connection to provide a data communication connection to a compatible LAN. Wireless links (e.g., RF or infrared) may also be implemented. In any such implementation, communication interface sends and receives electrical, electromagnetic or optical signals that carry digital data streams representing various types of information.

The network link typically provides data communication through one or more networks to other data devices. For example, the network link may provide a connection through local network to a host computer or to data equipment operated by an Internet Service Provider (ISP), which in turn provides data communication services through the worldwide packet data communication network, commonly referred to as the "Internet". The local network and Internet both use electrical, electromagnetic or optical signals that carry digital data streams. The signals through the various networks and the signals on network link and through communication interface, which carry the digital data to and from computer 210, are exemplary forms of carrier waves transporting the information.

Reservoirs 110*a*-110*d* each provide storage for a particular coin denomination and interior baffles may optionally be provided to reduce the direct weight of coins on a dispenser by supporting a portion of the load using angled plates. It is intended that the reservoirs 110*a*-110*d* provide an unobstructed gravity feed to the dispenser (e.g., dispensers 120*a*-120*d*), although a mechanical or assisted feed may also be provided in accord with the present concepts. Such mechanical or assisted feed may include, for example, one or more transducers or vibrating members configured to impart a vibration within the dispenser, or a movable member. Dispensers 120*a*-120*d* are designed to dispense a specific coin count (e.g., 72 coins) of a specific coin denomination (e.g., 1¢, 5¢, 10¢, 25¢) for a specified currency (e.g., coins minted by the United States Mint) upon receipt of an appropriate control signal from an associated controller or logic board and power board interface. In one aspect, the reservoirs are filled with a respective currency from an appropriate source such as, but not limited to Full Federal Bags, Half-Full Federal Bags, 19" through 12" coin bags, or coin sorter output bins. In an optional configuration, the reservoirs 110*a*-110*d* (or additional or fewer reservoirs, as needed) may be connected to an output of a conventional currency processing machine such as, but not limited to, the JetSort® manufactured by Cummins-Allison of Mt. Prospect, Ill., for direct deposit of sorted mixed coins into an appropriate one of the reservoirs 110*a*-100*d*, or additional reservoirs as may be the case. It is to be understood that the reservoirs 110*a*-110*d*, dispensers 120*a*-120*d*, collector point distribution 130, interface module tray 140, and all other systems and components herein described are applicable to all currencies and denominations of the United States and of other nations, states, republics and entities.

FIG. 2(*d*) shows a power supply 230 and conventional computer/processor 210, which power and regulate or control, respectively, the operation of dispensers 120*a*-120*d*. The dispensers 120*a*-120*d* are configured to dispense (e.g., sequentially), upon receipt of a control signal from computer 210, a predetermined number of coins of a respective denomination to a collection point distribution 130 by means of a gravity and/or mechanical feed such as, but not limited to, a computer controlled gate (not shown) or controlled feed mechanism. The number of coins may, for example, correspond to a difference between a measured stack height and a maximum stack height for a designated coin tray, cassette, hopper, or canister, the maximum stack height being stored in and retrieved from a conventional memory device.

In one aspect, a rotating disk could be disposed at a bottom of the dispensers 120*a*-120*d* to singulate and move coins at the bottom of the dispensers to a coin transport channel having one or more coin transport belts, such as described in U.S. Pat. Nos. 4,058,999 and 4,949,532, which are hereby incorporated in their entirety by reference. In another aspect, a device to output a predetermined number of coins of a respective denomination to a collection point distribution 130 could include, for example, a rotating drum having pockets for receiving individual coins dispersed thereover in a helical pattern to permit transport of a predetermined number of coins for a specified degree of rotation. Still other coin moving devices could include, but are in no means limited to, a worm gear disposed within a tube.

Although the reservoirs 110*a*-110*d* and dispensers 120*a*-120*d* are shown in a quad or 2×2 arrangement, the reservoirs and dispensers may also be arranged in any order and/or manner including, but not limited to, sequentially, laterally or vertically, staggered, stepped or in an arcuate path, in accord with the present concepts.

In one aspect, the dispensers 120*a*-120*d* may optionally be configured to hold one or more boluses or predetermined numbers of coins corresponding to a full complement of coins (or fraction thereof) for a designated coin tray, cassette, hopper, bag, and canister. For example, if a coin tray typically or exclusively used by an end-user holds a maximum of 100 quarters, the dispenser (e.g., 120*a*) could comprise one or more sections each adapted to hold 10, 20, 50, or 100 quarters in a pre-measured bolus. When a new (i.e., empty) dispenser tray 150 is inserted in-place adjacent the interface module, the dispenser could output the bolus(es) to cause a sequential filling of the coin channel(s) in the dispenser tray. The interface module 160 may optionally be configured to accept and route a parallel rather than a serial output from the dispensers 120*a*-*d*. In such aspect, a plurality of boluses of measured numbers of coins could be simultaneously directed through an interface module 160 have a plurality of coin paths or channels to a corresponding plurality of coin channels in a dispenser tray 150. Such pre-sorted during a system "downtime" permits faster filling. As to the fractional filling aspect, noted above, the computer 210 regulating the filling operation can, for example, instruct release of a predetermined combination of boluses (e.g., 3×20 quarters or 1×10 quarters and 1×50 quarters to get 60 quarters) once the requirements for a particular denomination are known (e.g., 67 quarters) and then instruct the appropriate dispenser (e.g., 120(*d*)) to output an additional small number of coins (e.g., 7 quarters) to complete the requirements.

The collection point distribution 130 collects any of a variety of coins from any of a series of coin dispensers (e.g., dispensers 120*a*-120*d*) and provides a point of distribution for filling a coin channel or coin channels in a dispenser tray 150 through an associated interface module 160. The collection point distribution 130, depicted as a chute or ramp in the illustrated example, may comprise any other conventional means of coin conveyance including, but not limited to rails, conveyor belts, moving platforms, rotating screws, guides, etcetera. The collection point distribution 130 may also be configured to vibrate to facilitate movement of coins thereover or therethrough. The interface module 160 may take any shape suitable to pass coins to a coin channel in a dispenser tray 150. The exemplary interface module 160 shown in FIGS. 2(*a*)-2(*d*) assumes a funnel-shape, but is not limited to such shape or closed surfaces. As used herein, the term funnel may include any body having one or more opposing, adjacent, and/or contiguous surfaces that converge toward one another over at least a portion of a length thereof so as to guide coins passing thereover to an opening common to the surfaces. The bottom opening of the interface module 160 may be circular, or may advantageously be oblong or flattened along one axis to force coins to pass vertically or substantially vertically therethrough.

In at least some embodiments, the bottom opening of the interface module 160 may comprise a vectored nozzle comprising opposing curved or flat plate portions that may be tilted toward or away from each other to regulate a distance between or may be pivoted substantially in unison to impart a desired exit angle to a coin passed therethrough. The geometry of the interface module 160 vectored nozzle is advantageously controlled by the computer 210 to correspond to a selected coin tray, cassette, hopper, bag, and canister, a desired throughput, a selected coin denomination, and selected other control inputs (e.g., programmed variations or limitations based on historical experience). The movement of the vectored nozzle may be achieved by any conventional actuator, solenoid, linear variable displacement transducer, or gear set, preferably self-locking, having a minimal size and cost. Output torque and speed are not significant factors, as the minimal amount of movement required could be effected prior to release of coins to the interface module 160.

The output of the interface module 160 may also be advantageously configured to impart a spin in a preferred direction to the coins output thereby, such as by passing the coin across an opening having one or more rotating rollers biased into contact with the coin periphery. The spin and increased angular momentum may help coins striking a stack edgewise to deflect toward a more horizontal position. The spin may also be achieved using a stationary member, which may be rigid, or may be flexible, such as a brush or bristles, to impart a bias to a preferred portion of a coin contacting such member. The stationary members could be provided in the interface module 160 itself and/or in or on the collector point distribution member.

In another aspect, a module cover (not shown) or adapter could be attached or removably attached to the coin tray 150 (e.g., coin tray, cassette, canister, tube, paper roll, etcetera) to facilitate placement of coins into the coin tray. In one aspect thereof, the module cover could cover the front of the coin tray and complete the cylinder geometry of the coin tray, if necessary, to facilitate the coin filling operation. The module cover could assume any configuration to guide coins from the interface module 160 to the top part of the coin tray 150 and into the individual denomination stacks. In another aspect, the module cover or adapter could be attached or removably attached to the interface module 160 to facilitate placement of coins into the coin tray, such as by extending the length and/or configuration of the funnel output. The module cover interfaces with one or more particular design of coin trays 150 and serves to facilitate movement of the coins to a predetermined location and/or serves to guide the coins in a manner which facilitates output of the coins in a substantially predetermined orientation.

In one aspect thereof, the physical configuration or geometry of the module cover could direct the coin to a specific orientation by supporting the coin at particular point(s) to enable external forces (resiliency of a resilient member, gravity, air pressure, friction, rotational forces imparted by rollers, forces of external objects such as brushes, etc.) to direct the coin into a particular orientation. This could include, for example, ramps, rails or wireforms. The application of external forces to achieve a desired orientation of coin may include, for example, opposing brushes defining a gap therebetween through which coins may pass. An additional brush could be provided along an axis perpendicular to the opposing brushes so as to constrain a coin passing therethrough to lay flat against a surface opposed to the additional brush (e.g., a slide or ramp). Such brushes, although noted in regard to the interface module 160 and the module cover (not shown), could be provided at any point in the system (e.g., dispenser output, collection point distribution 130, etc.) to control or influence the orientation of the coins.

In still another aspect, at least one of the module cover (not shown), coin tray or dispenser tray 150, and/or coin interface tray 170, may comprise one or more transducers, actuators, piezoelectric elements, or the like outputting an impulse and/or vibration so as to avoid stacking of coins within the dispenser tray 150 and/or to dislodge coins misaligned within the dispenser tray. Alternatively, one or more transducers, actuators, piezoelectric elements, or the like outputting an impulse and/or vibration may be provided adjacent the dispenser tray 150, module cover, and/or coin interface tray 170 to the same end. In yet another aspect, a pneumatic nozzle or pneumatic output device(s) may be coupled to a pneumatic supply and positioned (e.g., statically or movable along one or more axes) adjacent an opening or openings in the dispenser tray to blow a stream or pulse of high pressure air to dislodge or reorient misaligned coins.

In accord with the above, interface module 160 may be configured to provide a specific orientation of a coin during the placement of coin in the tray, cassette, hopper or canister.

In one aspect, the collection point distribution 130 is fixed and the interface module 160 translates relative thereto to dispose the output opening or spout of the interface module 160 in an appropriate position and/or orientation to output the selected denomination of coin into the proper dispenser tray 150 coin channel. This translation of the interface module 160 may be accomplished using any conventional drive mechanism including, but not limited to, a belt drive or a stepper motor. In this configuration, such as shown in FIGS. 2(*a*)-2(*d*), the base or top portion of the interface module 160 should be wide enough so that at either lateral extreme (i.e., left or right limit) of the interface module travel, the opening of the interface module is still positioned beneath the output of the collection point distribution 130 to receive coin therefrom. Thus, the dispensers 120*a*-120*d* collectively feed into a collector point distribution 130 where they are passed to interface module 160, which is configured to interface with at least one dispensing tray canister or cassette 150 for a given manufacturer, brand, and model number. It is preferred that the discharge opening of interface module 160 be configured to interface with more than one dispensing tray canister or cassette 150 for a given manufacturer, brand, and model number or, still more preferably, a range of dispensing tray canisters or cassettes for a number of given manufacturers, brands, and models.

In an alternate configuration, the collection point distribution 130 may itself translate laterally relative to the coin dispenser structure. This translation of the collection point distribution 130 may be accomplished using any conventional drive mechanism including, but not limited to, a belt drive or a stepper motor. The collection point distribution 130 may travel as a unit with the interface module 160 or may translate separately therefrom. In still another configuration, the base or rear of the collection point distribution 130 may rotate through a predetermined arc about a pivot point with the interface module 160 traveling an associated chord of the arc under the power of an appropriate conventional rotational drive system, such as a motor with an optional gear system or gear set. In this aspect, the depth of the interface module 160 should accommodate the varying extent of the collection point distribution 130 within the opening to the interface module 160. In additional configurations, the collection point distribution 130 may itself comprise a plurality of separate paths utilizing either conventional gravity or mechanical feed mechanisms to output coins to the interface module 160. In any of the above aspects, the tray 150, canister, or cassette may also be configured to translate, rotate, pivot, move, and/or vibrate relative to the collection point distribution 130 or interface module 160 to speed or facilitate the filling operation.

In yet another configuration, the collection point distribution 130 may comprise a plurality of separate paths utilizing either conventional gravity or mechanical feed mechanisms to output coins to an equal plurality of interface modules 160. In this latter aspect, each denomination of coin could have a separate reservoir, dispenser, collection point distribution and interface module 160, or each of these components may be integrated into one or more units having the same functions. The components could therefore be made stationary, which eliminates the need to include moving parts, motors, belts, separate actuators and the like and reduces system cost and maintenance. Each interface module 160 therein could be optionally manually movable along an x-axis, y-axis, and/or z-axis or any other defined axis or axes to accommodate trays, canisters, or cassettes of different configurations and sizes to enable the system to flexibly adapt to any such tray, canister, or cassette in the market or the majority thereof.

The coin interface tray 170 is a modular coin cassette which may be advantageously adapted to receive a specific tray brand and model number (e.g., a TELQUIP 2+ coin tray). In many instances, an end user will use a single type of coin dispenser and associated canister, cassette, or tray in multiple check-out locations and will need coin interface tray 170 for such specific canister, cassette, or tray. Thus, in one embodiment, the coin dispenser 100 can be pre-configured to correspond to a particular tray brand and model number, but could later be mechanically adjusted or adapted to receive another tray brand and/or model number, whether by manipulation of components in the automated coin dispenser 100 (e.g., repositioning movable rails or replacing interchangeable rails with new rails), alteration of the angle of the coin interface tray 170 relative to the housing, or by purchase of a replacement coin interface tray 170. Regarding the alteration of the angle of the coin interface tray 170 relative to the housing, the coin interface tray may be optionally arranged to assume any one angle in a predetermined range of angles, which may be positive, neutral, or negative with respect to the interface module 160 output. FIGS. 2(*a*)-2(*d*) show that the coin interface tray 170 is positioned with a slight positive angle relative to the interface module 160 output. In an embodiment wherein the coin interface tray 170 is configured to accept a coin tray of a predetermined make and model, coin channel information, such as the home position (coin denomination center position), maximum coin count per position, denomination sequence for successive coin channels, number of coin channels, etcetera, is known.

The automated coin dispenser 100 may be configured to not only rotate and/or pivot the coin interface tray 170 to adjust an angle thereof with respect to the vertical or other defined reference axis, but may also be configured to translate the coin interface tray laterally (e.g., along a x-axis), vertically (e.g., along a y-axis), and/or along any other defined axis or axes by means of a drive system 200, which may comprise a single drive system or a plurality of drive systems. This translation along one or more axes may be manual, wherein an operator inserting a coin tray 150 to be filled adjusts the lateral and/or vertical position of the coin interface tray 170 and coin tray 150, if necessary, to an appropriate position under the interface module 160. This translation along one or more axes may also be automated, wherein a drive system 200, such as one or more actuators or a belt drive adjusts, under instruction from the computer or processor 210, the lateral and/or vertical position (and/or along any other defined axis or axes) of the coin interface tray 170 and coin tray 150, if necessary, to a designated position under the interface module 160. As noted above, the computer or processor 210 may be "informed" of the particular coin tray 150 disposed for filling within the automated coin dispenser 100 by operator data entry using a conventional data entry device. In still another aspect, the automated coin dispenser 100 may comprise a vibrator (not shown) or actuator to vibrate or shake the coin interface tray 170 at one or more pre-selected frequencies and/or amplitudes or to cycle the coin interface tray through a range of selected frequencies and/or amplitudes to facilitate jogging of coins that are improperly disposed within the coin tray 150 into a preferred orientation.

In another aspect, the coin interface tray 170 may comprise "N" separate conductor surfaces, features (e.g., cavities/protrusions), or components defining switches. Each switch defines an information state, "on" or "off." In various non-limiting aspects, the coin interface tray 170 switches may comprise surface-mounted pressure switches, exposed physical contacts, or exposed conductors configured to contact exposed conductors on a coin tray, cassette, or canister to be received by the coin interface tray. The switches may also comprise non-contact devices, such as a plurality of light sources (e.g., laser diodes) arranged to output a beam toward a portion of a coin tray, cassette, or canister received by the coin interface tray 170 and light sensors (e.g., CCDs) arranged to measure a reflected light or an incident light (e.g., light through holes in the coin tray 150), depending on the configuration, from a respective portion of the coin tray, cassette, or canister. In this latter example, the intensity of the reflected light could be correlated to an "on" or "off" state. Alternatively, the light sensors may be configured to sense an absence of light output from a continuous, intermittent, or ambient light source (e.g., which light source becomes partially or fully occluded or blocked by a coin in the coin tray) and output a signal corresponding thereto.

The switches, whatever the form, could be pre-selected in number and location to define, in combination, a sufficient number of discrete states to uniquely define a specific manufacturer and model of coin tray, cassette, canister, or the like, inserted adjacent thereto. In one aspect, the switch remains in a first state (e.g., an "off" state), such as by having opposing switch elements being electrically disconnected from one another and assumes a second state (e.g., an "on" state) when the opposing elements of the switch are forced into electrical contact, or are otherwise electrically connected, by insertion of a coin tray, cassette, or canister having a feature to interact with the selected switch configuration. The switches may be directly connected to inputs of a processor, computer, or logic circuit or may be routed through a conventional multiplexer, I/O device, or register. In combination, a plurality of switches defines $2^N$ separate information states such that 4 switches (N=4) yields 16 discrete states and 8 switches (N=8) yields 256 discrete states. For a given population of coin trays or cassettes 150 desired to be associated with the automated coin tray refill system 100, the population will possess a variety of physical, electrical, magnetic, or optical characteristics, which permit configuration of the switches to uniquely identify each of the coin trays in the population. These characteristic data are stored in a conventional library or data base addressable by an address or pointer. The library or data base may be stored in a conventional memory device such as, but not limited to a ROM, solid-state memory device, hard-disk, floppy-disk, or CD-ROM drive.

Thus, for different pre-determined combinations of "N" switch states, the system 100 may access all necessary information regarding a coin tray or cassette 150 input into the coin interface tray 170 such as, but not limited to, coin tray or cassette home position, coin denomination center position, maximum coin count per position and/or denomination, coin tray or cassette denomination values, and coin tray center-coordinates relative to a predetermined reference point. In an example wherein the TELQUIP 2+ coin tray is inserted into the coin interface tray 170, pressure switches 1, 2, 4, 6, and 7 may be "on", while pressure switches 3, 5 and 8 may be "off". The computer or processor, upon accessing the library, matches these switch states with a pre-determined set of switch states uniquely assigned to the TELQUIP 2+ coin tray. Based on this unique association, the processor and computer code or instruction set will automatically set each system variable (e.g., home position, maximum coin count per position, coordinates of each coin tray, required positions of interface module 160, etc.) to accommodate the identified coin tray (e.g., TELQUIP 2+ coin tray). Thus, coin interface tray 170 may be a generic tray suitable to receive any one of a plurality of different coin trays 150, cassettes, canisters, or the like, from a variety of different manufacturers, whereupon the automated coin refill system is cooperatively associated with a memory device storing state information for such plurality of coin receptacles to enable the system to appropriately identify the type, style, manufacturer, and configuration of each coin receptacle.

In another aspect, the aforementioned switches are omitted and, instead, the user of the system is requested to input, such as through a touch screen display 190, the manufacturer and model number of a coin tray 150 to be filled. The information regarding such coin tray 150 (e.g., denominations, counts, spacing, etc.) is then accessed for use by the processor 210 and associated software and controls. In still another aspect, a single known coin tray 150 may be used and a coin interface tray 170, as such, is not required. The switches are merely one optional aspect of implemented a universal, automated coin filling system, but such a universal breadth is not a necessary part of the present concepts.

The automated coin tray refill system 100 may comprise a display 190, as shown in FIGS. 2(*a*)-2(*d*) and at least one data input device (e.g., display 190 may be a touch screen display) or, alternately, may comprise one or more conventional I/O ports to accept such devices. Display 190 is provided to provide visual feedback to an operator of the refill system 100. The computer 210 may be configured to display, upon execution of an appropriate code or instruction set, on display 190 information to notify the operator of a low count in any specific coin dispenser reservoir, indicate residual coin value per column, provide display for dispensing count and value per column, display day totals, tray totals and tray filling transactions, or alert the operator to an error in the system, such as a coin jam. The data input devices (e.g., touch-screen display 190) may also be adapted to require entry of an employee ID or code to track activity on the system 100, to limit access thereto, and to regulate functions accessible to various categories of users or operators.

In lieu of the aforementioned means by which the automated coin tray refill system 100 may automatically determine an exact make and model of a coin tray 150 inserted therein, a user of the automated coin tray refill system may, in one aspect, be prompted by an instruction on display 190 from the computer or processor 210 to enter the identifying, information for a particular coin tray 150, such as the manufacturer name, model number, configuration, etc., through an appropriate input device such as, but not limited to, a keyboard, touch screen display, mouse, microphone, bar code scanner, or soft key. This arrangement utilizes existing, system components, such as the processor 210 and display 190, to simplify the system architecture and reduce cost.

A conventional coin reader 180 is provided to provide to count the coins present in a specified stack or column of a coin tray. In one aspect, a single coin reader 180 is movably provided to translate or rotate between columns or trays of the coin tray 150 to determine a height of a coin stack therein. This translation of the coin reader 180 may be accomplished using any conventional drive mechanism including, but not limited to, a belt drive or a stepper motor. Alternatively, a plurality of movable coin readers 180 may be provided with an associated plurality of drive systems. In another aspect, a plurality of stationary coin readers 180 of an appropriate configuration may be provided. The coin reader(s) 180 is (are) configured to sense a coin height (or conversely a remaining height to be filled), with or independently of a processor, using conventional sensing arrangements including but not limited to, digital tape measures, fixed measurement tools, encoders (e.g., linear, rotatary, optical, etc.), mechanical switches, reflective sensors adapted to measure a reflected light from a LED or other light source or to measure a reflected acoustic or sound signal, or electrical resistance, capacitance, or hall effect position sensors (e.g., Honeywell SS400 series Hall effect digital position sensors), or even scales to measure a collected mass of coins. Any conventional coin reader or position sensor may be used in accord with the present concepts. The sensor or sensors may be positively or negatively configured to sense the presence of a sensed characteristic or, correspondingly, the absence of a sensed characteristic (i.e., sensing the presence of coins, or the absence or coins; sensing the activation of a switch or the non-activation of a switch), as desired. In combination with the computer or processor 210, the signals output by the coin reader(s) 180 are used to determine, for example, a residual coin count, a running coin count, and a final count.

In lieu of a coin reader 180 able to continuously monitor the exact number of coins present in (or coins absent from) a stack, one or more sensors or switches may be disposed at a position or more than one position to regulate the filling of the corresponding stack. For example, a sensor could be disposed at a 25% full point, a 50% full point, a 75% full point, a 95% full point and a 100% full point, or any other selected point or points, and the processor 210 in combination with associated software and controllers regulating the dispensing of coins from dispensers 120*a*-120*d*, could adjust the rate of flow so as not to overfill the tray or retain excess coinage in the interface module or other system components. In the event the combination of the control system components and sensors are not fast enough to prevent discharge of too many coins from the dispensers 120*a*-120*d*, a conventional bypass could be provided in the interface module 160 or collector point distribution member 130 to route excess coins into a holding area or escrow. As another option, the automated coin refilling system 100 may simply be configured to discharge a discrete predetermined amounts of coins, such as by offering a limited selection of options on display 190. For example, a user of the system may be offered the selection between $1, $2, $5, $10, $20, $30, $40, $50, etc. or any other value or increment, of any selected coin (e.g., penny, nickel, dime, quarter, etc.). These variables may clearly include any conventional denomination and container amount (e.g., a standard 40-quarter roll would take a $10 fill). Alternately, the user of the system may be offered the selected to dispense a selected quantity of coins of a selected denomination.

When a coin tray 150 is inserted into the coin interface tray 170 and is recognized by the automated coin tray refill system, or when such identifying information is entered by a user using an appropriate data input device, the computer or processor 210 may utilize the signals output by the coin reader 180 for each tray or stack of the coin tray to determine an initial state of the coin tray (e.g., full, empty, partially filled, etc.). For example, the coin reader 180 may output signals for each of the TELQUIP 2+ coin trays to the computer 210 which, upon accessing of the library information regarding the TELQUIP 2+ coin tray, can determine that the signals output by the coin reader 180 correspond to a 10 tray that is 20% full, an empty 5¢ tray, a 10% full 10¢ tray, and an empty 25¢ tray. The computer 210 can then to provide count and denomination instructions to the dispenser system.

In one aspect, the computer or processor 210 comprises a code chip and a library chip, which may be separate chips, partitioned portions of a single chip, or different logical units. The code chip comprises or is operatively associated with an instruction set or coding which, upon execution, interprets data output from the coin interface tray 170, compares that interpreted data to data stored in a library address, and separately stores or outputs the data of a library address found to correspond to the interpreted data. The code chip also interfaces with the display 190 and, upon execution of an appropriate code or instruction set based upon a corresponding signal from the code chip, issues a low coin alert for a specified denomination reservoir 110(*a*)-110(*d*).

The code chip further interfaces with the dispensers 120(*a*)-120(*d*) and coin reader 180 and, upon execution of an appropriate code or instruction set based upon a corresponding signal from the code chip, reads an existing coin count and value per column in the coin tray 150 tray or reads the dispensed value and coin count per column. The code chip is also configured to compile information including, for example, denomination totals and errors for individual filling sessions or for cumulative periods, such as day totals.

In various aspects, the code chip reads output signals from the respective drive systems and/or actuators which might employ position encoders (e.g., linear encoders, rotary encoders, incremental encoders, magnetic encoders, optical encoders, etc.) or other mechanisms or devices to provide an indication of incremental movement or step of the associated drive system or actuator, such as drive systems controlling the dispensers 120(*a*)-120(*d*), interface module 160, coin reader 180, and/or coin interface tray 170. The output signals from the respective drive signals and/or actuators provide information which may be correlated to the position of the drive system, such as the distance of a selected drive system component reference point from a home position. The code chip is also able to analyze thermal signals, such as might be output by a motor thermal overload circuit, and provide output signals with an appropriate pre-programmed response, such as to shut down an overheating motor and to display an error or warning message on display 190.

The code chip is also configured, by means of appropriate instructions sets and/or coding, to analyze electrical contact signals from the switches or other like components and access a library or data base to compare the plurality of switch states to known switch states for specified coin trays 150. The code chip is also configured, by means of appropriate instructions sets and/or coding, to analyze output signals from coin reader 180 to provide a current coin count or to calculate a residual coin depth/position (defining existing coin count or remaining coin count) and to correspondingly output a signal to the coin dispensers 120(*a*)-120(*d*) to output a number of coins needed to fill the coin tray 150 denomination, as well as to calculate sums, day totals, perform other similar types of calculations and write them to files for later access.

Figure 3:
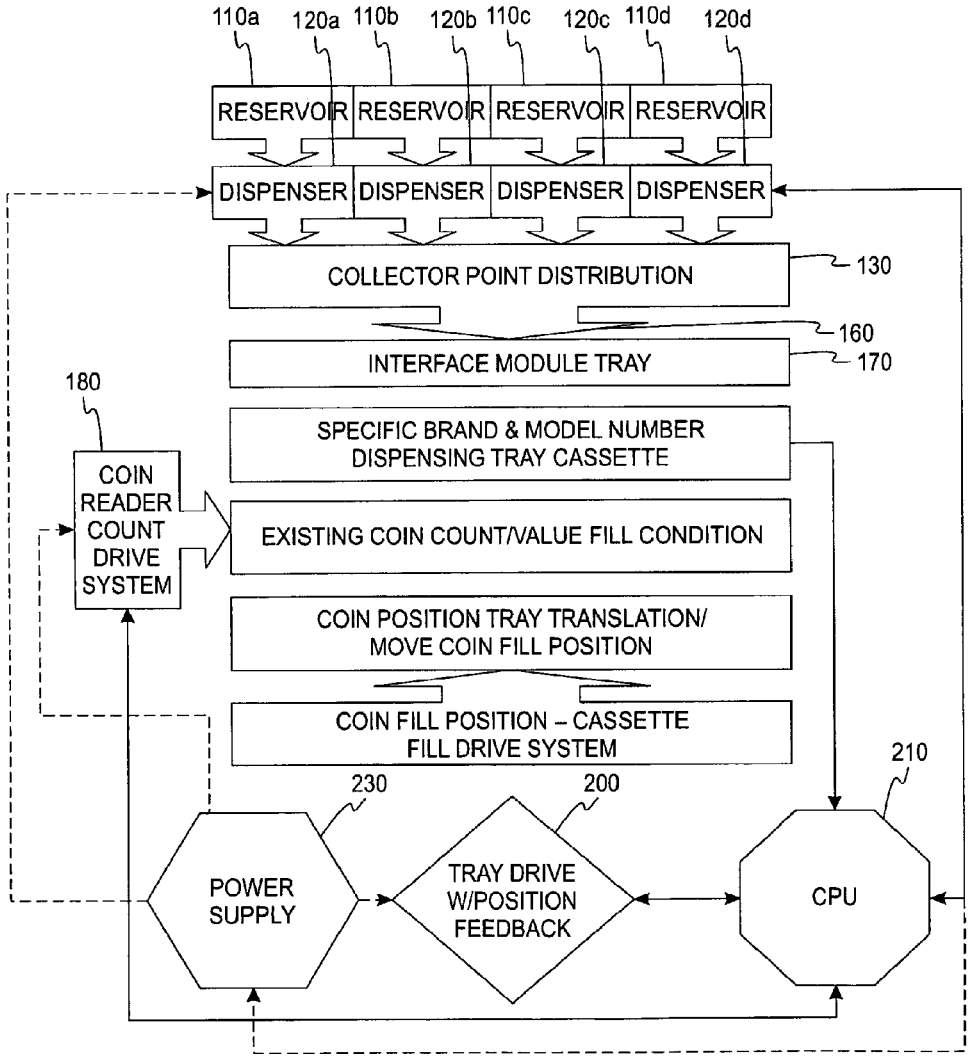
FIG. 3 shows a block diagram illustrates one aspect of a system for automated refill of a coin tray in accord with the present disclosure.

FIG. 3 shows a block diagram of a coin dispenser 100 in accord with the present concepts illustrating the relationship between some of the expected systems in the implementation herein described. FIG. 3 illustrates one approach to the automated method of filling coin trays, cassettes, hoppers, bags, and canisters in accord with the presently disclosed concepts and this depicted conceptual framework outlines some features characteristic of one aspect of automated coin tray refill device 100.

FIG. 3 shows, in block diagram form, a plurality of reservoirs 110*a*-110*d*, each reservoir feeding into a respective plurality of dispensers 120*a*-120*d*. The output from dispensers 120*a*-120*d* feeds into the collector point distribution 130 and then to the interface module tray 170 through an appropriate distribution device (e.g., a funnel, chute, or belt). A coin tray 150 of a specific brand and model number is disposed in the interface module tray 170 and switches or other identifying features (or operator input) are used to provide signals to the computer 210 to inform the automated coin tray refill device 100 of the particular characteristics of the coin tray. This characteristic information data is stored in a data base or library accessible to the computer 210. Once the coin tray 150 configuration is known, the computer 210 may then control, for example, a coin tray drive or coin interface module tray 170 drive and/or the coin reader 180 drive to position the coin tray 150 and/or coin reader 180 for initial inventorying or reading of the tray position. Such drive systems would advantageously comprise encoders adapted to provide position feedback signals to the computer 210. The computer 210 controls the output from the dispensers 120(*a*)-120(*d*) and monitors, for example, the coin fill position, coin count, and value fill conditions using the coin reader 180.

It is to be noted that the processor 210 and associated software and instructions may be configured to vary any of the above noted variables (e.g., position and/or rotational orientation of the coin tray; configuration of funnel output; rate of dispensing of coins from dispensers 120*a*-120*d*; movement, rotation, vibration, and/or operating speed of collector point distribution member 130, as applicable, etc.) dynamically during any portion of the refilling process. For example, the coin interface tray 170 angle with respect to the interface module 160 may vary between a pre-selected range of angles and/or the output configuration of the interface module output may be adjusted during filling of a giving denomination to take into account the particular characteristics and behaviors of each type of coin throughout the filling process.

While the present concepts have been described with reference to one or more particular embodiments, those skilled in the art will recognize that many changes may be made thereto without departing from the spirit and scope of the concepts presented herein. For example, although the disclosure discusses the example wherein the coin tray 150 channels are sequentially filled, the coin dispenser 100 could be configured to fill a plurality of channels simultaneously, such as in the aspect of the disclosure wherein a plurality of interface modules 160 and/or a plurality of collector point distribution members 130 are provided. Moreover, a plurality of coin trays 150 could also be processed and filled simultaneously with appropriate multiplication of coin tray receiving areas and interface modules. In one aspect thereof, a single coin source (e.g., a coin reservoir or a coin sorting machine) may dispense coins to a plurality of affixed coin trays (e.g., quarters to one tray having multiple quarter coin channels, dimes to another tray having multiple dime coin channels, a mixture of quarters, nickels, dimes to yet another coin tray, etc.).

In still other potential modifications, the output of the interface module 160 could be configured, via a conventional mechanical connection device (e.g., a threaded portion), to receive any one of a plurality of different adapters configured to correspond to a specified coin tray. Such adapters could be particularly useful to fill individual coin tubes or paper roll tubes. In still another example, the coin interface tray 170 and the coin tray 150 could be integrated into a single unit.

In accord with another aspect, a method for automatic filling of a coin receptacle comprises the steps of providing an automated coin tray refilling system having at least one coin reservoir and providing at least one coin dispenser for regulating the dispensing of coins. The method also includes providing a collector point distribution member adapted to receive coins from coin dispenser(s) at one portion thereof and to output the coins at another portion thereof. The method further includes the step of providing an interface module having an input end disposed to receive coins output from the collector point distribution member and having an output end for dispensing coins, as well as a coin interface tray adapted to receive a coin tray, paper coin roll, and/or coin tube. The method further includes the step of providing a processor(s), wherein the interface module and/or coin interface tray comprise a drive system configured to move a respective one of the interface module and coin interface tray. The method also includes the steps of disposing a coin tray in the coin receiving area and activating the automated coin dispenser.

Each of these embodiments and obvious variations thereof is contemplated as falling within the spirit and scope of the disclosure, set forth in the following claims. For example, the individual coin channels in the dispenser trays 150 may be filled sequentially or non-sequentially and may be filled single or in plural (i.e., more than one coin channel (e.g., some, all) being filled substantially simultaneously). Further, various components described herein may be combined without departing from the concepts presented herein such as, but not limited to, the interface module 160 may be integrated with the collector point distribution 130 or the collector point distribution may be integrated with the dispensers 120*a-d*.

The appended claims reflect certain aspects and combinations of the present concepts, but are not exhaustive of all such aspects and combinations. Further, the present concepts include all possible logical combinations of the claims and of the various claim elements appended hereto, without limitation, within the associated claim sets regardless of the presently indicated dependency.

What is claimed is:

1. An automated coin tray refilling system comprising:

a plurality of coin reservoirs;

a plurality of coin dispensers for regulating the dispensing of coins from an associated one of the plurality of coin reservoirs;

a collector point distribution member adapted to receive coins from each of the plurality of coin dispensers at one portion thereof and to output the coins at another portion thereof;

an interface module having an input end disposed substantially adjacent the collector point distribution member output and having an output end for dispensing coins;

a coin interface tray adapted to receive at least one coin tray; and at least one processor;

wherein at least one of the interface module and coin interface tray comprises a drive system configured to move a respective one of the interface module and coin interface tray relative to the other one of the interface module and coin interface tray.

2. An automated coin tray refilling system according to claim 1, wherein each of the interface module and coin interface tray comprises a drive system.

3. An automated coin tray refilling system according to claim 1, wherein the coin interface tray comprises a drive system configured to move the coin interface tray along a plurality of axes.

4. An automated coin tray refilling system according to claim 1, wherein the coin interface tray drive system comprises a drive system configured to rotate the coin interface tray.

5. An automated coin tray refilling system according to claim 1, wherein the interface module comprises a funnel.

6. An automated coin tray refilling system comprising:

an interface module having an input end adapted to receive coins from a coin source and an output end for dispensing coins; and a coin interface tray adapted to receive at least one coin tray;

at least one processor;

wherein at least one of the interface module and coin interface tray comprises a drive system operatively associated with the processor and configured to move a respective one of the interface module and coin interface tray relative to the other one of the interface module and coin interface tray.

7. A method for automatic filling of a coin receptacle comprising the steps of:

providing an automated coin dispenser comprising an interface module having an input end adapted to receive coins from a coin source and an output end for dispensing coins, a coin receiving area adapted to receive at least one coin receptacle, and at least one processor, wherein at least one of the interface module and receiving area comprises a drive system operatively associated with the processor and configured to move a respective one of the interface module and coin receiving area relative to the other one of the interface module and coin receiving area;

disposing a coin receptacle in the coin receiving area;

activating the automated coin dispenser.

* * * * *